US010847291B2

(12) United States Patent
Urata et al.

(10) Patent No.: US 10,847,291 B2
(45) Date of Patent: Nov. 24, 2020

(54) SOFT MAGNETIC POWDER, DUST CORE, MAGNETIC COMPOUND AND METHOD OF MANUFACTURING DUST CORE

(71) Applicant: TOKIN CORPORATION, Sendai (JP)

(72) Inventors: Akiri Urata, Sendai (JP); Miho Chiba, Sendai (JP)

(73) Assignee: TOKIN CORPORATION, Sendai (JP)

( * ) Notice: Subject to any disclaimer, the term of this patent is extended or adjusted under 35 U.S.C. 154(b) by 0 days.

(21) Appl. No.: 16/089,334

(22) PCT Filed: Feb. 6, 2018

(86) PCT No.: PCT/JP2018/004021
§ 371 (c)(1),
(2) Date: Sep. 27, 2018

(87) PCT Pub. No.: WO2018/150952
PCT Pub. Date: Aug. 23, 2018

(65) Prior Publication Data

US 2019/0156975 A1 May 23, 2019

(30) Foreign Application Priority Data

Feb. 16, 2017 (JP) ..... 2017-027162
Oct. 25, 2017 (JP) ..... 2017-206608

(51) Int. Cl.
*C22C 38/20* (2006.01)
*H01F 1/153* (2006.01)
(Continued)

(52) U.S. Cl.
CPC ..... *H01F 1/15308* (2013.01); *B22F 1/00* (2013.01); *B22F 3/00* (2013.01); *B22F 3/24* (2013.01);
(Continued)

(58) Field of Classification Search
CPC ..... B22F 1/00; B22F 3/00; B22F 3/24; C22C 2200/04; C22C 45/02; H01F 1/14733;
(Continued)

(56) References Cited

U.S. PATENT DOCUMENTS 7,132,019 B2 * 11/2006 Koshiba ..... H01F 1/15308 148/304
8,287,665 B2 * 10/2012 Urata ..... B22F 9/08 148/104
(Continued)

FOREIGN PATENT DOCUMENTS

CN 104681227 A 6/2015
JP 01139702 A 6/1989
(Continued)

OTHER PUBLICATIONS

International Search Report (ISR) dated Apr. 24, 2018 issued in International Application No. PCT/JP2018/004021.
(Continued)

*Primary Examiner* — Jie Yang
(74) *Attorney, Agent, or Firm* — Holtz, Holtz & Volek PC

(57) ABSTRACT

A soft magnetic powder is represented by $Fe_aSi_bB_cP_dCr_eM_f$ except for inevitable impurities, wherein: M is one or more element selected from V, Mn, Co, Ni, Cu and Zn; 0 atomic %≤b≤6 atomic %; 4 atomic %≤c≤10 atomic %; 5 atomic %≤d≤12 atomic %; 0 atomic %<e; 0.4 atomic %≤f<6 atomic %; and a+b+c+d+e+f=100 atomic %.

21 Claims, 2 Drawing Sheets

(51) Int. Cl.

| | |
|---|---|
| ***H01F 1/147*** | (2006.01) |
| ***C22C 38/34*** | (2006.01) |
| ***C22C 45/02*** | (2006.01) |
| ***H01F 27/255*** | (2006.01) |
| ***C22C 38/32*** | (2006.01) |
| ***B22F 3/00*** | (2006.01) |
| ***B22F 1/00*** | (2006.01) |
| ***C22C 38/02*** | (2006.01) |
| ***C22C 38/60*** | (2006.01) |
| ***B22F 3/24*** | (2006.01) |
| ***C22C 38/28*** | (2006.01) |
| ***H01F 27/28*** | (2006.01) |
| ***H01F 41/02*** | (2006.01) |
| ***H01F 27/24*** | (2006.01) |
| ***H01F 3/08*** | (2006.01) |
| *H01F 27/29* | (2006.01) |

(52) U.S. Cl.
CPC ..... *C22C 38/02* (2013.01); *C22C 38/20* (2013.01); *C22C 38/28* (2013.01); *C22C 38/32* (2013.01); *C22C 38/34* (2013.01); *C22C 38/60* (2013.01); *C22C 45/02* (2013.01); *H01F 1/14733* (2013.01); *H01F 1/153* (2013.01); *H01F 1/15333* (2013.01); *H01F 3/08* (2013.01); *H01F 27/24* (2013.01); *H01F 27/255* (2013.01); *H01F 27/2847* (2013.01); *H01F 41/0246* (2013.01); *C22C 2200/04* (2013.01); *H01F 27/2852* (2013.01); *H01F 27/292* (2013.01)

(58) Field of Classification Search
CPC .. H01F 1/153; H01F 1/15308; H01F 1/15333; H01F 27/24; H01F 27/255; H01F 41/0246
USPC ..... 148/304
See application file for complete search history.

(56) References Cited

U.S. PATENT DOCUMENTS

| | | | | |
|---|---|---|---|---|
| 9,287,028 | B2 * | 3/2016 | Urata | C21D 6/00 |
| 9,850,562 | B2 * | 12/2017 | Urata | C21D 6/00 |
| 2010/0043927 | A1 * | 2/2010 | Makino | C22C 38/02 148/612 |
| 2010/0084056 | A1 | 4/2010 | Ohta et al. | |
| 2010/0097171 | A1 | 4/2010 | Urata et al. | |
| 2012/0199254 | A1 | 8/2012 | Urata et al. | |
| 2013/0278366 | A1 | 10/2013 | Makino | |
| 2016/0177429 | A1 | 6/2016 | Urata et al. | |
| 2018/0073117 | A1 | 3/2018 | Urata et al. | |
| 2018/0154434 | A1 | 6/2018 | Henmi et al. | |
| 2018/0169759 | A1 * | 6/2018 | Nakamura | B22F 3/00 |

FOREIGN PATENT DOCUMENTS

| | | | |
|---|---|---|---|
| JP | H04018712 | A | 1/1992 |
| JP | 2004156134 | A | 6/2004 |
| JP | 2009174034 | A | 8/2009 |
| JP | 2009293099 | A | 12/2009 |
| JP | 4514828 | B2 | 7/2010 |
| JP | 4584350 | B2 | 11/2010 |
| JP | 4629807 | B1 | 2/2011 |
| JP | 2011149045 | A | 8/2011 |
| JP | 5327075 | B2 | 10/2013 |
| JP | 5455041 | B2 | 3/2014 |
| JP | 2014075528 | A | 4/2014 |
| JP | 2014075529 | A | 4/2014 |
| JP | 5537534 | B2 | 7/2014 |
| JP | 5632608 | B2 | 11/2014 |
| JP | 5912349 | B2 | 4/2016 |
| JP | 5916983 | B2 | 5/2016 |
| JP | 2016104900 | A | 6/2016 |
| JP | 6046357 | B2 | 12/2016 |
| JP | 2017031464 | A | 2/2017 |
| WO | 2008129803 | A1 | 10/2008 |
| WO | 2011024580 | A1 | 3/2011 |
| WO | 2017022227 | A1 | 2/2017 |
| WO | 2017022594 | A1 | 2/2017 |

OTHER PUBLICATIONS

Japanese Office Action dated Nov. 15, 2017 issued in counterpart Japanese Application No. 2017-206608.
Written Opinion dated Apr. 24, 2018 issued in International Application No. PCT/JP2018/004021.
Chinese Office Action (and English language translation thereof) dated Apr. 9, 2019 issued in counterpart Chinese Application No. 201880001453.2.
Chinese Office Action dated Sep. 23, 2019 (and English translation thereof) issued in Chinese Application No. 201880001453.2.

* cited by examiner

SOFT MAGNETIC POWDER, DUST CORE, MAGNETIC COMPOUND AND METHOD OF MANUFACTURING DUST CORE

TECHNICAL FIELD

This invention relates to a soft magnetic powder which is suitable for use in a magnetic compound such as a dust core or the like.

BACKGROUND ART

Patent Document 1 discloses a soft magnetic alloy consisting of Fe, Si, B and Cu. The soft magnetic alloy of Patent Document 1 is manufactured to have strip form by quenching a molten metal, which has a predetermined elemental composition, by using a chill roll extrusion method. In addition, Patent Document 2 discloses, as Example 5, a soft magnetic powder which contains $Fe_{bal}Si_{10}B_{11}P_5Cr_{0.5}$ and Cu of 0.09 wt %. A manufacturing process of the soft magnet powder of Patent Document 2 uses water atomization as a quenching method.

PRIOR ART DOCUMENTS

Patent Document(s)

Patent Document 1: JP A 2011-149045
Patent Document 2: JP A 2009-174034

SUMMARY OF INVENTION

Technical Problem

There is a need for a soft magnetic alloy, which is used in a magnetic component such as a dust core or the like, to have powder form because the soft magnetic alloy in powder form is easy to be molded to have a desired shape. If a soft magnetic powder is manufactured from the strip form of the soft magnetic alloy of Patent Document 1 in a process, the process has a drawback as follows; the process requires an additional pulverization step so that the process is complicated, the soft magnetic powder having a spherical shape is hardly to be manufactured, and the soft magnetic powder manufactured in the process has poor moldability. If a manufacturing process of the soft magnetic alloy of Patent Document 1 uses water atomization or a method including gas atomization followed by water quenching, a soft magnetic powder is directly obtained from the molten metal, so that the manufacturing process has an advantage that the soft magnetic powder can be manufactured in a simplified manner. Since the soft magnetic alloy of Patent Document 1 contains no Cr which prevents its rusting, the soft magnetic powder may rust when the molten metal is processed by water, so that the soft magnetic powder manufactured therein is unreliable. Since the soft magnetic powder of Example 5 of Patent Document 2 contains large amounts of Si and B while containing Cr which prevents its rusting, the soft magnetic powder may have poor soft magnetic properties.

It is therefore an object of the present invention to provide a soft magnetic powder which resists rust while having good soft magnetic properties.

Solution to Problem

An aspect of the present invention provides a soft magnetic powder represented by $Fe_aSi_bB_cP_dCr_eM_f$ except for inevitable impurities, wherein: M is one or more element selected from V, Mn, Co, Ni, Cu and Zn; 0 atomic %≤b≤6 atomic %; 4 atomic %≤c≤10 atomic %; 5 atomic %≤d≤12 atomic %; 0 atomic %<e; 0.4 atomic %≤f<6 atomic %; and a+b+c+d+e+f=100 atomic %.

Advantageous Effects of Invention

Since the soft magnetic powder according to the present invention contains Fe, Si, B, P, Cr and M (M is one or more element selected from V, Mn, Co, Ni, Cu and Zn) each of whose atomic percent is within a predetermined range, the soft magnetic powder is formed with an oxide layer containing Cr on a surface thereof while containing a large amount of an amorphous phase. Accordingly, the soft magnetic powder of the present invention resists rust while having good soft magnetic properties. In addition, since the soft magnetic powder resists rust, a manufacturing process of the soft magnetic powder of the present invention can use a quenching method that utilizes a refrigerant such as water providing excellent cooling ability, the quenching method advantageously allowing for mass production of the soft magnetic powder.

An appreciation of the objectives of the present invention and a more complete understanding of its structure may be had by studying the following description of the preferred embodiment and by referring to the accompanying drawings.

DESCRIPTION OF EMBODIMENTS

Figure 1:
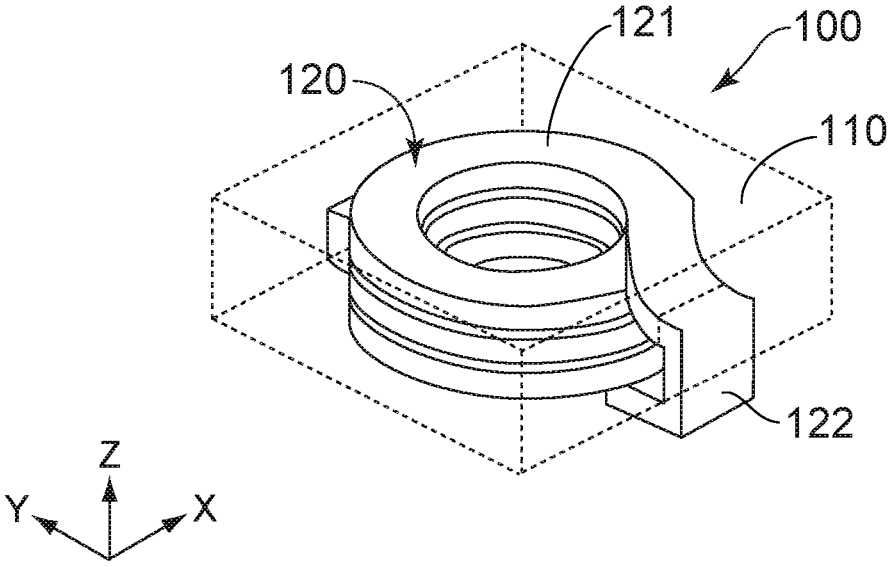
FIG. 1 is a perspective view showing an inductor according to an embodiment of the present invention. In the figure, an outline of a dust core is illustrated by dotted line.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

A soft magnetic powder according to the present embodiment is represented by $Fe_aSi_bB_cP_dCr_eM_f$ except for inevitable impurities. $Fe_aSi_bB_cP_dCr_eM_f$ meets the following conditions: M is one or more element selected from V, Mn, Co, Ni, Cu and Zn; 0 atomic %≤b≤6 atomic %; 4 atomic %≤c≤10 atomic %; 5 atomic %≤d≤12 atomic %; 0 atomic %<e; 0.4 atomic %≤f<6 atomic %; and a+b+c+d+e+f=100 atomic %.

The soft magnetic powder of the present embodiment is usable as a starting material for manufactures of various magnetic components, a dust core and a magnetic core of an inductor.

The soft magnetic powder of the present embodiment can be manufactured by a method such as atomization or the like. The thus-manufactured soft magnetic powder has (an amorphous phase) an amorphous phase as a main phase. The soft magnetic powder of the present invention is preferred to contain nanocrystals. The soft magnetic powder containing nanocrystals is obtained by heat-treating the soft magnetic powder under a predetermined heat treatment condition to crystallize bccFe (αFe) nanocrystals.

Generally, when the soft magnetic powder is subjected to a heat treatment under inert atmosphere such as argon gas atmosphere, the soft magnetic powder is crystallized at two times or more. A temperature at which first crystallization starts is defined as "first crystallization start temperature ($T_{x1}$)", and another temperature at which second crystallization starts is defined as "second crystallization start temperature ($T_{x2}$)". In addition, a temperature difference $\Delta T=T_{x2}-T_{x1}$ is between the first crystallization start temperature ($T_{x1}$) and the second crystallization start temperature ($T_{x2}$). An exothermic peak at the first crystallization start temperature ($T_{x1}$) is due to crystallization of αFe nanocrystals, while an exothermic peak at the second crystallization start temperature ($T_{x2}$) is due to deposition of compounds of FeB, FeP or the like. These crystallization start temperatures can be evaluated through a heat analysis which is carried out, for example, by using a differential scanning calorimetry (DSC) apparatus under the condition that a temperature increase rate is about 40° C. per minute.

In order to crystallize αFe nanocrystals in the soft magnetic powder, the soft magnetic powder is preferred to be heat-treated at a temperature equal to or lower than the second crystallization start temperature ($T_{x2}$) so that the soft magnetic powder is prevented from being converted to a compound phase. In a case where ΔT is large, the soft magnet powder is easy to be heat-treated under the predetermined heat treatment condition. In that case, the soft magnetic powder having good soft magnetic properties can be easily obtained by the heat treatment which crystallizes only αFe nanocrystals. Specifically, by adjusting an elemental composition of the soft magnetic powder, in order to increase ΔT, followed by heat-treating the adjusted soft magnetic powder, the soft magnetic powder has a stable αFe nano crystalline structure, so that a dust core and a magnetic core of an inductor, each of which comprises the soft magnetic powder containing αFe nanocrystals, have reduced core loss.

Hereafter, explanation is made further in detail about composition ranges of the soft magnetic powder according to the present embodiment.

In the soft magnetic powder according to the present embodiment, the Fe element is a principal component and an essential element to provide magnetism. It is basically preferable that the Fe content is high for increase of a saturation magnetic flux density Bs of the soft magnetic powder and for reduction of cost of starting materials of the soft magnetic powder. To obtain the soft magnetic powder having a high saturation magnetic flux density Bs, the Fe content is preferred to be equal to or greater than 78 atomic % while the Fe content is preferred to be equal to or less than 85 atomic %. If the Fe content is 78 atomic % or greater, ΔT is increased in addition to the aforementioned effect. To further increase a saturation magnetic flux density Bs by increase of the Fe content, the Fe content is more preferred to be equal to or greater than 79 atomic % and is further preferred to be equal to or greater than 80.5 atomic %. If the Fe content is more than 85 atomic %, the soft magnetic powder containing the amorphous phase of 90% or greater cannot be obtained because the Fe content is excessive. In order to permanently obtain the soft magnetic powder containing a large amount of the amorphous phase, the Fe content is preferred to be equal to or less than 83.5 atomic %.

In the soft magnetic powder according to the present embodiment, the Si element is an element to enable a molten metal to be converted to the amorphous phase and contributes to stabilization of nanocrystals upon nano-crystallization. To reduce core loss of the dust core or the magnetic core of the inductor, the Si content is required to be equal to or less than 6 atomic % (including zero). If the Si content is greater than 6 atomic %, the soft magnetic powder containing the amorphous phase of 90% or greater cannot be obtained because the Si content is excessive so that the molten metal has reduced ability of being converted to the amorphous phase. Since even a small amount of Si in the soft magnetic powder increases ability of conversion of the molten metal to the amorphous phase and stability of the starting materials upon melting thereof, the soft magnetic powder is preferred to include Si, and the Si content is more preferred to be equal to or greater than 0.1 atomic %. In addition, the Si content is preferred to be equal to or greater than 2 atomic % in order to increase ΔT.

In the soft magnetic powder according to the present embodiment, the B element is an essential element to enable the molten metal to be converted to the amorphous phase. In order that the soft magnetic powder has the amorphous phase of 90% or greater so that core loss of the dust core or the magnetic core of the inductor is reduced, the B content is required to be equal to or greater than 4 atomic % while the B content is required to be equal to or less than 10 atomic %. If the B content is greater than 10 atomic %, a melting point of the molten metal is dramatically high, so that the molten metal, which has a dramatically increased melting point, is unfavorable in a manufacturing process of the soft magnetic powder and so that the molten metal has reduced ability of being converted to the amorphous phase. If the B content is less than 4 atomic %, the contents of Si, B and P, which are metalloid elements, are unbalanced so that the molten metal has reduced ability of being converted to the amorphous phase.

In the soft magnetic powder according to the present embodiment, the P element is an essential element to enable the molten metal to be converted to the amorphous phase. As described above, the P content of the present embodiment is equal to or greater than 5 atomic % while the P content of the present embodiment is equal to or less than 12 atomic %. If the P content is equal to or greater than 5 atomic %, the molten metal can have increased ability of being converted to the amorphous phase so that the soft magnetic powder contains an increased amount of the amorphous phase while having stable soft magnetic properties. In the P content is greater than 12 atomic %, the contents of Si, B and P, which are metalloid elements, are unbalanced so that the molten metal has reduced ability of being converted to the amorphous phase while the soft magnetic powder has a further reduced saturation magnetic flux density Bs. The P content is preferred to be equal to or less than 10 atomic % because a saturation magnetic flux density Bs of the soft magnetic powder is prevented from being reduced. In addition, the P content is preferred to be equal to or less than 8 atomic % because the soft magnetic powder having homogeneous nano structures can be easily obtained after the heat treatment so that the soft magnetic powder having good soft magnetic properties can be obtained. The P content is preferred to be greater than 5 atomic % because the molten metal can have increased ability of being converted to the amorphous phase so that the soft magnetic powder has stable soft magnetic properties. The P content is preferred to be greater than 6 atomic % because the soft magnetic powder has improved corrosion-proof characteristic, and the P content is still preferred to be greater than 8 atomic % because the soft magnetic powder is spheroidized upon its atomization so that a packing ratio of the soft magnetic powder is increased, and also because the soft magnetic powder has further improved corrosion-proof characteristic while the soft magnetic powder having homogeneous nano structures can be easily obtained after the heat treatment.

In the soft magnetic powder according to the present embodiment, the Cr element is an essential element to prevent the soft magnetic powder rusting. As described above, the Cr content of the soft magnetic powder according to the present embodiment is greater than 0 atomic %. Specifically, if the Cr content is greater than 0 atomic %, the soft magnetic powder is formed with an oxide layer on a surface thereof to resist rust and the soft magnetic powder contains a large amount of the amorphous phase. Since the soft magnetic powder is formed with the oxide layer on its surface, the surface of the manufactured soft magnetic powder does not rust in a case where the soft magnetic powder is manufactured by a quenching method utilizing water. The Cr content is preferred to be equal to or less than 3 atomic % in order to obtain the soft magnetic powder having a high saturation magnetic flux density Bs, and the Cr content is more preferred to be equal to or less than 1.8 atomic % in order to reduce core loss. The Cr content is preferred to be equal to or less 1.5 atomic % in order to obtain the soft magnetic powder having a high saturation magnetic flux density Bs, and the Cr content is more preferred to be equal to or less than 1.0 atomic % in order to obtain the soft magnetic powder having a higher saturation magnetic flux density Bs. Additionally, to increase rust resistivity of the soft magnetic powder, the Cr content is preferred to be equal to or greater than 0.1 atomic % and is more preferred to be equal to or greater than 0.5 atomic %.

In the soft magnetic powder according to the present embodiment, the M element is an essential element. The M content according to the present embodiment is equal to or greater than 0.4 atomic % and is less than 6 atomic %. The soft magnetic powder including both of the M element and the P element dramatically resists corrosion. Specifically, the M content is required to be equal to or greater than 0.4 atomic % in order that enlargement of nanocrystals in the soft magnetic powder is prevented so that the dust core has desired core loss, and the M content is required to be less than 6 atomic % in order that the soft magnetic powder contains the amorphous phase of 90% or greater by the molten metal having sufficient ability of being converted to the amorphous phase.

The M element is preferred to include Cu having a content which is 0.4 atomic % or more and which is less than 0.7 atomic %. In detail, the M element is preferred to meet following conditions: $M_f$ is represented by $Cu_gM'_h$; M' is one or more element selected from V, Mn, Co, Ni and Zn; 0.4 atomic %≤g<0.7 atomic %; and f=g+h. If the M element meets the above conditions, the soft magnetic powder has increased resistance to rust and has further increased ability of being converted to the amorphous phase. Because the soft magnetic powder containing a large amount of the amorphous phase can be obtained, the Cu content is preferred to be less than 0.7 atomic % and is more preferred to be 0.65 atomic % or less. The Cu content is preferred to be equal to or greater than 0.4 atomic % because a large amount of αFe nanocrystals is crystallized in the soft magnetic powder so that the soft magnetic powder having homogeneous nano structures can be easily obtained, and the Cu content is more preferred to be equal to or greater than 0.5 atomic % because the soft magnetic powder has dramatically improved resistance to corrosion and also because an amount of crystallized αFe nanocrystals in the soft magnetic powder is further increased so that the soft magnetic powder has improved soft magnetic properties.

As described above, the Cr content of the soft magnetic powder of the present embodiment is e (atomic %). The Cu content is preferred to be equal to or greater than (0.2e−0.1) atomic % while the Cu content is preferred to be equal to or less than (2e+0.5) atomic %. The P content is preferred to be equal to or greater than (6−2e) atomic % and is preferred to be equal to or less than (21−5e) atomic %. If the Cu and P contents each represented by using the Cr content e (atomic %) are arranged as those described above, the soft magnetic powder of the present embodiment has further increased resistance to rust while having better soft magnetic properties.

The soft magnetic powder of the present embodiment is preferred to meet following condition: Fe is replaced with at least one element selected from Nb, Zr, Hf, Mo, Ta, W, Ag, Au, Pd, K, Ca, Mg, Sn, Ti, Al, S, C, O, N, Y and rare-earth elements at 3 atomic % or less. If the soft magnetic powder includes the above described element(s), it is easy to form homogeneous nanocrystals in the soft magnetic powder by the heat treatment.

In microelements included in the soft magnetic powder of the present embodiment, Al, Ti, S, N and O are microelements which come from the starting materials and the manufacturing process and which are included therein. Accordingly, the soft magnetic powder may contain these microelements having various contents. These microelements affect soft magnetic properties of the manufactured soft magnetic powder. Thus, the contents of these microelements included in the soft magnetic powder are required to be controlled in order to obtain the soft magnetic powder having good soft magnetic properties.

In these microelements, the Al is a microelement which is included in the soft magnetic powder manufactured by a process where industrial starting materials such as Fe—P and Fe—B are used. The inclusion of the Al in the soft magnetic powder causes the soft magnetic powder to contain a reduced amount of the amorphous phase and to have reduced soft magnetic properties. Thus, the Al content is preferred to be equal or less than 0.05 wt % in order that the soft magnetic powder is prevented from containing a reduced amount of the amorphous phase, and the Al content is more preferred to be equal to or less than 0.005 wt % in order that the soft magnetic powder contains an increased amount of the amorphous phase while being prevented from having reduced soft magnetic properties.

In these microelements, the Ti is a microelement which is included in the soft magnetic powder manufactured by the process where the industrial starting materials such as Fe—P and Fe—B are used. The inclusion of the Ti in the soft magnetic powder causes the soft magnetic powder to contain a reduced amount of the amorphous phase and to have reduced soft magnetic properties. Thus, the Ti content is preferred to be equal or less than 0.05 wt % in order that the soft magnetic powder is prevented from containing a reduced amount of the amorphous phase, and the Ti content is more preferred to be equal to or less than 0.005 wt % in order that the soft magnetic powder contains an increased amount of the amorphous phase while being prevented from having reduced soft magnetic properties.

In these microelements, the S is a microelement which is included in the soft magnetic powder manufactured by the process where the industrial starting materials such as Fe—P and Fe—B are used. A small content of the S in the soft magnetic powder promotes spheroidization of the soft magnetic powder. However, if the soft magnetic powder contains an excess content of the S, the excess content of the S causes the soft magnetic powder to have heterogeneous nanocrystals and to have reduced soft magnetic properties. Thus, in order that the soft magnetic powder is prevented from having reduced soft magnetic properties, the S content is preferred to be equal or less than 0.5 wt % and is more preferred to be equal to or less than 0.05 wt %

In these microelements, the N is a microelement which comes from industrial starting materials to be included in the soft magnetic powder or comes from air, upon the atomization or the heat treatment, to be included therein. The inclusion of the N in the soft magnetic powder causes a reduction of an amount of the amorphous phase in the soft magnetic powder, a reduction of a packing ratio upon a molding of the soft magnetic powder and a reduction of soft magnetic properties of the soft magnetic powder. Thus, in order that the soft magnetic powder is prevented from containing a reduced amount of the amorphous phase and from having reduced soft magnetic properties, the N content is preferred to be equal or less than 0.01 wt % and is more preferred to be equal to or less than 0.002 wt %.

In these microelements, the O is a microelement which comes from starting industrial materials to be included in the soft magnetic powder or comes from air, upon the atomization or drying, to be included therein. The inclusion of the O in the soft magnetic powder causes a reduction of an amount of the amorphous phase in the soft magnetic powder, a reduction of a packing ratio upon a molding of the soft magnetic powder and a reduction of soft magnetic properties of the soft magnetic powder. Thus, in order that the soft magnetic powder is prevented from containing a reduced amount of the amorphous phase and from having reduced soft magnetic properties, the O content is preferred to be equal or less than 1.0 wt % and is more preferred to be equal to or less than 0.3 wt %. In the present embodiment, the soft magnetic powder is formed with the oxide layer containing Cr on its surface, so that a small amount of the O is intentionally included in the soft magnetic powder. In addition to the oxide layer as described above, the soft magnetic powder may have improved insulating property between the soft magnetic powders by forming an insulating coating, which is made of resin or ceramic, on the surface of the soft magnetic powder, and the O content of the soft magnetic powder including the oxide layer and the insulating coating may be greater than 1.0 wt %.

Hereafter, explanation is made further in detail about the soft magnetic powder, the dust core, the magnetic component and the magnetic core of the inductor while methods of manufacturing the soft magnetic powder, the dust core, the magnetic component and the magnetic core of the inductor are explained.

The soft magnetic powder according to the present embodiment may be manufactured by various methods. For example, the soft magnetic powder may be manufactured by atomization such as water atomization or gas atomization. Since the soft magnetic powder of the present embodiment contains the Cr which prevents its rusting, the surface of the soft magnetic powder does not rust when the soft magnetic powder is manufactured by a quenching method utilizing water. A process of manufacturing the soft magnetic powder, namely, a powder manufacturing process by atomization, starts with preparation of the starting materials. Next, the starting materials are respectively weighted so as to form a predetermined composition, and the weighted materials are melted to form a molten metal. In that period, the soft magnetic powder of the present embodiment has a reduced melting point, so that electricity consumption for melting the weighted materials can be reduced. After that, the molten metal is discharged from a nozzle to be divided into metal droplets by using high pressure gas or high pressure water, so that the soft magnetic powder having fine particles is manufactured In the powder manufacturing process as described above, the gas which uses for dividing the molten metal may be inert gas such as argon or nitrogen. To increase a quenching speed of the metal droplets, the metal droplets formed just after the division may be brought into contact with liquid or solid, which are used for quenching the metal droplets, to be quenched, or the metal droplets may be divided one more time to form more fine particles. If liquid is used for quenching the metal droplets, the liquid may be water or oil. If solid is used for quenching the metal droplets, the solid may be, for example, a rotating roller made of copper or a rotating plate made of aluminum. However, the liquid and the solid for quenching the metal droplets are not limited thereto and may be various materials. In addition, since the soft magnetic powder of the present embodiment contains Cr which prevents its rusting, the powder manufacturing process uses a quenching method utilizing water, the quenching method advantageously allowing for mass production of the soft magnetic powder.

In the powder manufacturing process as described above, a particle shape and a particle diameter of the soft magnetic powder can be adjusted by modifying manufacturing conditions. According to the present embodiment, the soft magnetic powder is easy to be manufactured in spherical particle form because the molten metal has a reduced viscosity. An average particle diameter of the soft magnetic powder of the present embodiment is preferred to be 200 μm or less, and the average particle diameter of the soft magnetic powder of the present embodiment is more preferred to be 100 μm or less in order that the soft magnetic powder has an increased amount of the amorphous phase. If the soft magnetic powder has extreme wide variety in particle size distribution, this can result in an undesired particle size segregation of the soft magnetic powder. Thus, a maximum particle diameter of the soft magnetic powder is preferred to be 200 μm or less. The soft magnetic powder of the present embodiment is preferred to contain the amorphous phase of 90% or greater. Thus, the soft magnetic powder of the present embodiment has excellent soft magnetic properties. In addition, the soft magnetic powder of the present embodiment has a tap density of 3.5 g/cm$^3$ or greater. Accordingly, when the dust core is manufactured by using the soft magnetic powder of the present embodiment, a content of the soft magnetic powder in the dust core is increased.

The particle diameter of the soft magnetic powder can be measured by laser diffraction particle size analyzer. The average particle diameter of the soft magnetic powder is calculated by the measured particle diameters. Peak positions of X-ray diffraction pattern of the soft magnetic powder can identify precipitate phases such as an αFe (—Si)

phase and the compound phase. The tap density is measured according to JIS Z2512 (metal powder—tap density measuring method).

When the soft magnetic powder, which is manufactured in the powder manufacturing process as described above, is heat-treated as described above, αFe nanocrystals are crystallized in the soft magnetic powder, so that the soft magnetic powder containing nanocrystals can be manufactured. This heat treatment is required to be done at a temperature equal to or lower than the second crystallization start temperature (Tx2) in order that the soft magnetic powder is prevented from being converted to the compound phase. In addition, this heat treatment is preferred to be done at a temperature equal to or lower than 300° C. under inert gas atmosphere such as argon or nitrogen. The soft magnetic powder may be heat-treated under a partially oxidative atmosphere in order that the surface of the soft magnetic powder is formed with an oxide layer to have improved corrosion resistance and improved insulating property. To improve a surface condition of the soft magnetic powder, the soft magnetic powder may be heat-treated under a partial reducing atmosphere.

If an average diameter of αFe nanocrystal, which is crystallized by the aforementioned heat treatment in the soft magnetic powder, is greater than 50 nm, the soft magnetic powder has higher magnetocrystalline anisotropy and decreased soft magnetic properties. If the average diameter of αFe nanocrystal is greater than 40 nm, the soft magnetic powder has slightly decreased soft magnetic properties. Thus, the average diameter of αFe nanocrystal is preferred to be equal to or less than 50 nm, and the average diameter of αFe nanocrystal is more preferred to be equal to or less than 40 nm.

If αFe nanocrystal, which is crystallized in the soft magnetic powder by the heat treatment as described above, has a crystallinity of 35% or greater, the soft magnetic powder has an increased saturation magnetic flux density Bs of 1.6 T or greater. Thus, αFe nanocrystal is preferred to have the crystallinity of 35% or greater. From a standpoint of preventing reduction of soft magnetic properties, the compound phase, other than a bcc phase, of αFe nanocrystal crystallized in the soft magnetic powder by the aforementioned heat treatment is preferred to have a crystallinity of 7% or less, and the compound phase is more preferred to have a crystallinity of 5% or less, and the compound phase is further preferred to have a crystallinity of 3% or less.

The average diameter and the crystallinity of αFe nanocrystal, and the crystallinity of the compound phase, other than the bcc phase, of αFe nanocrystal are calculated by analyzing results of X-ray diffraction analysis (XRD: X-ray diffraction) by WPPD method (whole-powder-pattern decomposition method). Saturation magnetic flux density Bs is calculated from a saturation magnetization, which is measured by using a vibrating-sample magnetometer (VMS: Vibrating Sample Magnetometer), and a density.

The dust core can be manufactured by using the soft magnetic powder which is manufactured in the powder manufacturing process as described above. For example, the dust core can be manufactured by molding the soft magnetic powder in a predetermined shape, followed by heat-treating it under a predetermined heat treatment condition. In addition, magnetic compounds such as a transformer, an inductor, a motor and a generator can be manufactured by using the soft magnetic powder. Hereafter, explanation is made about the method of manufacturing the dust core of the present embodiment using the soft magnetic powder.

The method of manufacturing the dust core of the present embodiment comprises: forming a mixture of the soft magnetic powder and a binder; manufacturing a molded body by press-molding the mixture; and heat-treating the molded body.

In a process of forming the mixture of the soft magnetic powder and the binder, the soft magnetic powder of the present embodiment is mixed with the binder having good insulating property such as resin or the like to form the mixture (granulated powder). If resin is used as the binder, the resin may be, for example, silicone, epoxy resin, phenol resin, melamine resin, polyurethane, polyimide and polyamide-imide. To increase insulating property and binding property of the mixture, materials such as phosphate, borate, chromate, oxide (silica, alumina, magnesia or the like) and inorganic polymer (polysilane, polygermane, polystannane, polysiloxane, polysilsesquioxane, polysilazane, polyborazylene, polyphosphazen or the like) may be used as the binder instead of or together with resin. A plurality of the binders may be used, and a coating comprising two or more layers may be formed on the soft magnetic powder by using different binders. Since the method of manufacturing the dust core comprises heat-treating the molded body as described above, the binder having high heat resistance is preferred to be used in the method of manufacturing the dust core. In general, an amount of the binder is preferred to be in about a range of 0.1 to 10 wt %, and the amount of the binder is preferred to be in about a range of 0.3 to 6 wt % in consideration with the insulating property and the packing ratio. It is sufficient that the amount of the binder can be properly determined in consideration with the particle diameter, an applicable frequency and a purpose or the like.

Next, in a process of manufacturing the molded body by press-molding the mixture, the granulated powder is press-molded by using a mold to obtain the molded body. At the time of press-molding the granulated powder, the granulated powder may be mixed with one kind or more kinds of powders such as Fe, FeSi, FeSiCr, FeSiAl, FeNi, carbonyl iron powder or the like, which are softer than the soft magnetic powder of the present embodiment, in order to increase the packing ratio and to suppress heat generation upon crystallization of nanocrystals. The granulated powder may be mixed with any soft magnetic powder, which has a particle diameter different from that of the soft magnetic powder according to the present embodiment, instead of or together with the aforementioned softer powder. In this case, a mixing ratio of the aforementioned powder to the soft magnetic powder according to the present embodiment is preferred to be equal to or less than 75 wt %.

After that, the molded body is heat-treated under a predetermined heat treatment condition. This heat treatment crystallizes αFe nanocrystals in the soft magnetic powder. This heat treatment is similar to the heat treatment to the soft magnetic powder as described above, and this heat treatment is required to be done at a temperature equal to or lower than the second crystallization start temperature (Tx2). In addition, this heat treatment is preferred to be done at a temperature equal to or less than 300° C. under inert gas atmosphere such as argon or nitrogen. The soft magnetic powder may be heat-treated under a partially oxidative atmosphere in order that a surface of the molded body is formed with an oxide layer to have improved corrosion resistance and improved insulating property. To improve a surface condition of the molded body, the soft magnetic powder may be heat-treated under a partially reducing atmosphere.

If an average diameter of αFe nanocrystal, which is crystallized by the aforementioned heat treatment in the soft magnetic powder forming the dust core, is greater than 50 nm, the soft magnetic powder has higher magnetocrystalline anisotropy and decreased soft magnetic properties. If the average diameter of αFe nanocrystal is greater than 40 nm, the soft magnetic powder has slightly decreased soft magnetic properties. Thus, the average diameter of αFe nanocrystal is preferred to be equal to or less than 50 nm, and the average diameter of αFe nanocrystal is more preferred to be equal to or less than 40 nm.

If αFe nanocrystal, which is crystallized by the aforementioned heat treatment in the soft magnetic powder forming the dust core, has a crystallinity of 35% or greater, the dust core can have an increased saturation magnetic flux density and a decreased magnetostriction. From a standpoint of core loss of the dust core, the compound phase, other than the bcc phase, of αFe nanocrystal crystallized by the aforementioned heat treatment in the soft magnetic powder forming the dust core is preferred to have a crystallinity of 7% or less, and the compound phase is more preferred to have a crystallinity of 5% or less, and the compound phase is further preferred to have a crystallinity of 3% or less.

The average diameter and the crystallinity of αFe nanocrystal, and the crystallinity of the compound phase, other than the bcc phase, of αFe nanocrystal are calculated by analyzing results of X-ray diffraction analysis (XRD: X-ray diffraction) by WPPD method (whole-powder-pattern decomposition method).

Although the dust core of the present embodiment is manufactured from the soft magnetic powder, which is not heat-treated, as a starting material, the present invention is not limited thereto, and the dust core may be manufactured from a soft magnetic powder, which is heat-treated to crystallize αFe nanocrystals, as a starting material. In this case, the dust core can be manufactured by granulating a mixture followed by press-molding a granulated powder similar to the method of manufacturing the dust core as described above.

The magnetic core of the inductor can be manufactured by using the soft magnetic powder which is manufactured in the powder manufacturing process as described above. Hereafter, explanation is made about a method of manufacturing the magnetic core, which uses the soft magnetic powder, of the inductor of the present embodiment.

The method of manufacturing the magnetic core of the inductor comprises forming a mixture of the soft magnetic powder and a binder, manufacturing a molded body by press-molding the mixture and a coil together, and heat-treating the molded body.

Since a process, of the present embodiment, of forming the mixture of the soft magnetic powder and the binder is similar to that of the method of manufacturing the dust core described above, detailed explanation thereabout is omitted.

In a process of manufacturing the molded body by press-molding the mixture and the coil together, the coil is positioned in a metal mold, the mixture (granulated powder) is poured into the metal mold, and the mixture (granulated powder) and the coil are press-molded together to manufacture the molded body. At the time of press-molding the mixture (granulated powder) and the coil together, the granulated powder may be mixed with one kind or more kinds of powders such as Fe, FeSi, FeSiCr, FeSiAl, FeNi, carbonyl iron powder or the like, which are softer than the soft magnetic powder of the present embodiment, in order to increase the packing ratio and to suppress heat generation upon crystallization of nanocrystals. The granulated powder may be mixed with any soft magnetic powder, which has a particle diameter different from that of the soft magnetic powder according to the present embodiment, instead of or together with the aforementioned softer powder. In this case, a mixing ratio of the aforementioned powder to the soft magnetic powder according to the present embodiment is preferred to be equal to or less than 75 wt %.

Since a process of heat-treating the molded body is also similar to that of the method of manufacturing the dust core described above, detailed explanation thereabout is omitted.

If an average diameter of αFe nanocrystal, which is crystallized by the aforementioned heat treatment in the soft magnetic powder forming the magnetic core of the inductor, is greater than 50 nm, the soft magnetic powder has high magnetocrystalline anisotropy and decreased soft magnetic properties. If the average diameter of αFe nanocrystal is greater than 40 nm, the soft magnetic powder has slightly decreased soft magnetic properties. Thus, the average diameter of αFe nanocrystal is preferred to be equal to or less than 50 nm, and the average diameter of αFe nanocrystal is more preferred to be equal to or less than 40 nm.

If αFe nanocrystal, which is crystallized by the aforementioned heat treatment in the soft magnetic powder forming the magnetic core of the inductor, has a crystallinity of 35% or greater, the dust core can have an increased saturation magnetic flux density and a decreased magnetostriction. From a standpoint of core loss of the magnetic core of the inductor, the compound phase, other than the bcc phase, of αFe nanocrystal crystallized by the aforementioned heat treatment in the soft magnetic powder forming the magnetic core of the inductor is preferred to have a crystallinity of 7% or less, and the compound phase is more preferred to have a crystallinity of 5% or less, and the compound phase is further preferred to have a crystallinity of 3% or less.

The average diameter and the crystallinity of αFe nanocrystal, and the crystallinity of the compound phase, other than the bcc phase, of αFe nanocrystal are measured in a manner similar to those of the dust core as described above.

Although the magnetic core of the inductor of the present embodiment is manufactured from the soft magnetic powder, which is not heat-treated, as a starting material, the present invention is not limited thereto, and the magnetic core of the inductor may be manufactured from a soft magnetic powder, which is heat-treated to crystallize αFe nanocrystals, as a starting material. In this case, the magnetic core of the inductor can be manufactured by granulating a mixture followed by press-molding a granulated powder similar to the method of manufacturing the magnetic core of the inductor as described above.

Regardless of manufacturing process, the soft magnetic powder of the present embodiment is used in the dust core and the magnetic core of the inductor of the present embodiment which are manufactured as above. Similarly, the soft magnetic powder of the present embodiment is used in the magnetic compound of the present embodiment.

An embodiment of the present invention will be described below in further detail with reference to several examples.

Examples 1 to 12 and Comparative Examples 1 to 8

Industrial pure iron, ferrosilicon, ferrophosphorus, ferroboron and electrolytic copper were prepared as starting materials of soft magnetic powders of Examples 1 to 12 and Comparative Examples 1 to 8 as listed below in Table 1. The starting materials were respectively weighed so as to provide alloy compositions of Examples 1 to 12 and Comparative Examples 1 to 8 as listed in Table 1 and were melted by a high-frequency heating apparatus under argon atmosphere to form molten metals. Next, the formed molten metals were gas atomized and quenched in cooling water to manufacture soft magnetic powders each of whose average particle diameter is 50 μm. A rust condition of a surface of each of the manufactured soft magnetic powders was examined by visual inspection. An amount of an amorphous phase was estimated by identifying precipitate phases of each of the manufactured soft magnetic powders by X-ray diffraction analysis (XRD: X-ray diffraction). The manufactured soft magnetic powders were heat-treated by an electric furnace under argon atmosphere at heat treatment temperatures shown in Table 1. Saturation magnetic flux density Bs of each of the heat-treated soft magnetic powders was measured by using a vibrating-sample magnetometer (VMS). The measurement and examination results of the manufactured soft magnetic powders are shown in Table 1.

TABLE 1

| | Alloy Composition | Atomized Powder | | | |
|---|---|---|---|---|---|
| | | Amorphous Phase (%) | Rust | Heat Treatment Temperature (° C.) | Bs (T) |
| Comparative Example 1 | $Fe_{85.18}Si_{0.7}B_{10.2}P_{3.1}Cu_{0.82}$ | 42 | X | 400 | 1.82 |
| Comparative Example 2 | $Fe_{83.7}Si_{1.8}B_{9.2}P_{4.1}Cu_{0.68}Cr_{0.52}$ | 96 | Δ | 420 | 1.74 |
| Example 1 | $Fe_{82.79}Si_4B_{5.5}P_{6.5}Cu_{0.69}Cr_{0.52}$ | 98 | ○ | 420 | 1.72 |
| Example 2 | $Fe_{82.28}Si_3B_{4.2}P_{9.4}Cu_{0.6}Cr_{0.52}$ | 99 | ◎ | 420 | 1.66 |
| Example 3 | $Fe_{81}Si_4B_{8.4}P_{5.1}Cu_{0.6}Cr_{0.9}$ | 99 | ○ | 420 | 1.67 |
| Example 4 | $Fe_{79.32}Si_5B_7P_{7.2}Cu_{0.58}Cr_{0.9}$ | 100 | ◎ | 440 | 1.64 |
| Example 5 | $Fe_{78.54}Si_5B_7P_{7.9}Cu_{0.66}Cr_{0.9}$ | 100 | ◎ | 440 | 1.61 |
| Comparative Example 3 | $Fe_{76.43}Si_7B_7P_{8.1}Cu_{0.57}Cr_{0.9}$ | 100 | ◎ | 460 | 1.54 |
| Example 6 | $Fe_{83.42}B_6P_9Cu_{0.68}Cr_{0.9}$ | 98 | ◎ | 380 | 1.65 |
| Example 7 | $Fe_{83.42}Si_{0.1}B_6P_{8.9}Cu_{0.68}Cr_{0.9}$ | 100 | ◎ | 400° C. | 1.66 |
| Example 8 | $Fe_{83.42}Si_2B_5P_{8.4}Cu_{0.68}Cr_{0.5}$ | 100 | ◎ | 420° C. | 1.7 |
| Example 9 | $Fe_{81.2}Si_6B_5P_{6.6}Cu_{0.6}Cr_{0.6}$ | 96 | ○ | 460° C. | 1.65 |
| Comparative Example 4 | $Fe_{81.4}Si_7B_4P_{6.6}Cu_{0.6}Cr_{0.4}$ | 64 | Δ | 480° C. | 1.68 |
| Example 10 | $Fe_{80.78}Si_{2.5}B_{4.3}P_{11.3}Cu_{0.6}Cr_{0.52}$ | 100 | ◎ | 370 | 1.56 |
| Example 11 | $Fe_{80.55}Si_4B_6P_{8.1}Cu_{0.65}Cr_{0.7}$ | 100 | ○ | 400° C. | 1.65 |
| Example 12 | $Fe_{80.4}Si_{4.6}B_{4.5}P_{8.5}Cu_{0.6}Cr_{1.4}$ | 98 | ○ | 420° C. | 1.56 |
| Comparative Example 5 | $Fe_{80.08}Si_2B_{3.8}P_{13}Cu_{0.6}Cr_{0.52}$ | 84 | ◎ | 370 | 1.52 |
| Comparative Example 6 | FeSiCr | — | ◎ | — | 1.64 |
| Comparative Example 7 | FeSiB | — | X | 380 | 1.55 |
| Comparative Example 8 | FeSiBCr | — | ○ | 380 | 1.32 |

As shown in Table 1, Comparative Example 1 containing no Cr contains an amorphous phase of 42% which is low, and rust is formed on a surface of Comparative Example 1. Similarly, rust is formed on a surface of Comparative Example 7 which is an Fe-based amorphous alloy and which contains no Cr. Comparative Example 5 containing Cr contains an amorphous phase of 84% which is low. Comparative Example 4 containing Cr contains an amorphous phase of 64% which is low, and rust is formed thereon. On the other hand, Examples 1 to 12 contain amorphous phases of 96 to 100%. In other words, Examples 1 to 12 contain the amorphous phases of 90% or more. In addition, no rust is formed on surfaces of Examples 1 to 12. Comparative Examples 3, 5, 7 and 8 have saturation magnetic flux densities Bs of 1.32 to 1.55 T. In other words, All of Comparative Examples 3, 5, 7 and 8 have the saturation magnetic flux densities Bs of 1.55 T or less. On the other hand, Examples 1 to 12 have saturation magnetic flux densities Bs of 1.56 to 1.72 T. In other words, All of Examples 1 to 12 have the saturation magnetic flux densities Bs of 1.56 T or more.

Dust cores were manufactured by using the soft magnetic powders of Examples 1 to 12 and Comparative Examples 1 to 8. In detail, the soft magnetic powders manufactured as above were granulated by using silicone resin of 2 wt %, the granulated powders were molded at a molding pressure of 10 ton/cm$^2$, by using dies each having an outer diameter of 13 mm and an inner diameter of 8 mm, to manufacture molded bodies, and the molded bodies were cured. After that, the molded bodies were heat-treated by an electric furnace under argon atmosphere at heat treatment temperatures shown in Table 1, so that the dust cores were manufactured. Core loss of each of the manufactured dust cores was measured by using an alternating current BH analyzer under excitation conditions of 20 kHz and 100 mT. Additionally, a temperature and humidity controlled test, in which the manufactured dust cores were aged at 60° C. and 90% RH, was run, and a corrosion condition of each of the manufactured dust cores was visually inspected. Furthermore, an average particle diameter and a crystallinity of αFe nanocrystal in the soft magnetic powder, which was contained in the manufactured dust core, were calculated by proving a surface of the manufactured dust core by XRD, followed by analyzing the XRD result by WPPD method. The measurement and examination results of the manufactured dust cores are shown in Table 2. The soft magnetic powders which were used in manufacturing the dust cores of Examples 6, 7 and 8 were analyzed by DSC, and values ΔT were calculated from the obtained DSC curve.

TABLE 2

| | Alloy Composition | Dust Core | |
|---|---|---|---|
| | | Core Loss (kW/m$^3$) | Temperature and Humidity Controlled Test |
| Comparative Example 1 | $Fe_{85.18}Si_{0.7}B_{10.2}P_{3.1}Cu_{0.82}$ | 1240 | X |
| Comparative Example 2 | $Fe_{83.7}Si_{1.8}B_{9.2}P_{4.1}Cu_{0.68}Cr_{0.52}$ | 210 | X |
| Example 1 | $Fe_{82.79}Si_4B_{5.5}P_{6.5}Cu_{0.69}Cr_{0.52}$ | 100 | ○ |
| Example 2 | $Fe_{82.28}Si_3B_{4.2}P_{9.4}Cu_{0.6}Cr_{0.52}$ | 110 | ○ |
| Example 3 | $Fe_{81}Si_4B_{8.4}P_{5.1}Cu_{0.6}Cr_{0.9}$ | 120 | Δ |
| Example 4 | $Fe_{79.32}Si_5B_7P_{7.2}Cu_{0.58}Cr_{0.9}$ | 70 | ○ |
| Example 5 | $Fe_{78.54}Si_5B_7P_{7.9}Cu_{0.66}Cr_{0.9}$ | 80 | ○ |
| Comparative Example 3 | $Fe_{76.43}Si_7B_7P_{8.1}Cu_{0.57}Cr_{0.9}$ | 75 | ○ |
| Example 6 | $Fe_{83.42}B_6P_9Cu_{0.68}Cr_{0.9}$ | 90 | ○ |
| Example 7 | $Fe_{83.42}Si_{0.1}B_6P_{8.9}Cu_{0.68}Cr_{0.9}$ | 80 | ○ |
| Example 8 | $Fe_{83.42}Si_2B_5P_{8.4}Cu_{0.68}Cr_{0.5}$ | 75 | ○ |
| Example 9 | $Fe_{81.2}Si_6B_5P_{6.6}Cu_{0.6}Cr_{0.6}$ | 160 | ○ |
| Comparative Example 4 | $Fe_{81.4}Si_7B_4P_{6.6}Cu_{0.6}Cr_{0.4}$ | 1450 | Δ |
| Example 10 | $Fe_{80.78}Si_{2.5}B_{4.3}P_{11.3}Cu_{0.6}Cr_{0.52}$ | 140 | ○ |
| Example 11 | $Fe_{80.55}Si_4B_6P_{8.1}Cu_{0.65}Cr_{0.7}$ | 90 | ○ |
| Example 12 | $Fe_{80.4}Si_{4.6}B_{4.5}P_{8.5}Cu_{0.6}Cr_{1.4}$ | 140 | ○ |
| Comparative Example 5 | $Fe_{80.08}Si_2B_{3.8}P_{13}Cu_{0.6}Cr_{0.52}$ | 920 | ○ |
| Comparative Example 6 | FeSiCr | 230 | ○ |
| Comparative Example 7 | FeSiB | 120 | X |
| Comparative Example 8 | FeSiBCr | 130 | Δ |

As shown in Table. 2, core losses of Comparative Examples 1 to 8 are 75 to 1450 kW/m$^3$. On the other hand, core losses of Examples 1 to 12 are 70 to 160 kW/m$^3$. In other words, All of the core losses of Examples 1 to 12 are low values. The temperature and humidity controlled test causes Comparative Examples 1, 2 and 7 to have corrosion while causing none of Examples 1 to 12 to have corrosion.

In the aforementioned measurement and examination results, comparison of Comparative Example 1 with Comparative Example 2 from a standpoint of amorphous phase and rust formation indicates that the Fe content of the soft magnetic powder is preferred to be equal to or less than 85 atomic %. Comparison of Comparative Example 2 with Example 1 from the standpoint of amorphous phase and rust formation indicates that the Fe content of the soft magnetic powder is more preferred to be equal to or less than 83.5 atomic %. Comparison of Example 5 with Comparative Example 3 from a standpoint of saturation magnetic flux density Bs indicates that the Fe content of the soft magnetic powder is preferred to be equal to or greater than 78 atomic %. Comparison of Example 4 with Example 5 from the standpoint of saturation magnetic flux density Bs indicates that the Fe content of the soft magnetic powder is more preferred to be equal to or greater than 79 atomic %. Comparison of Example 11 with Example 12 from the standpoint of saturation magnetic flux density Bs indicates that the Fe content of the soft magnetic powder is further preferred to be equal to or greater than 80.5 atomic %.

In the aforementioned measurement and examination results, comparison of Example 6 with Example 7 from a standpoint of core loss indicates that the Si content of the soft magnetic powder is preferred to be equal to or greater than 0.1 atomic %. Comparison of Example 9 with Comparative Example 4 from the standpoint of core loss indicates that the Si content of the soft magnetic powder is preferred to be equal to or less than 6 atomic %.

From the aforementioned DSC analysis, values ΔT of the soft magnetic powders, which are used in manufacturing the dust cores of Examples 6, 7 and 8, are calculated to be 89° C., 93° C. and 105° C., respectively. These results teach that ΔT increases as increasing the Si content. Especially, it is understood that the Si content is more preferred to be equal to or greater than 2 atomic % because ΔT is preferred to be equal to or greater than 100° C. in a case where a large core having a weight of about 10 g or more is molded.

In the aforementioned measurement and examination results, comparison of Comparative Example 1 with Comparative Example 2 from a standpoint of amorphous phase and core loss indicates that the B content of the soft magnetic powder is preferred to be equal to or less than 10 atomic %. Comparison of Example 10 with Comparative Example 5 from the standpoint of amorphous phase and core loss indicates that the B content of the soft magnetic powder is preferred to be equal to or greater than 4 atomic %.

In the aforementioned measurement and examination results, comparisons of Example 10, Comparative Example 5, Comparative Example 7 and Comparative Example 8 from the standpoint of saturation magnetic flux density Bs indicate that the P content of the soft magnetic powder is preferred to be equal to or less than 12 atomic %. Comparisons of Example 6, Example 10 and Comparative Example 6 from the standpoint of saturation magnetic flux density Bs indicate that the P content of the soft magnetic powder is more preferred to be equal to or less than 10 atomic %. Comparison of Example 5 with Comparative Example 3 from the standpoint of saturation magnetic flux density Bs indicates that the P content of the soft magnetic powder is further preferred to be equal to or less than 8 atomic %. Comparison of Comparative Example 2 with Example 3 from the standpoint of core loss indicates that the P content of the soft magnetic powder is preferred to be equal to or greater than 5 atomic %. Comparisons of Comparative Example 2, Example 1, Comparative Example 7 and Comparative Example 8 from the standpoint of core loss and the temperature and humidity controlled test indicate that the P content of the soft magnetic powder is more preferred to be greater than 6 atomic %. Comparison of Example 8 with Example 9 from the standpoint of amorphous phase and core loss indicates that the P content of the soft magnetic powder is further preferred to be greater than 8 atomic %.

In the dust core of Example 1, an average particle diameter of αFe nanocrystal which is crystallized therein is calculated to be 36 nm, and a crystallinity of αFe nanocrystal which is crystallized therein is calculated to be 51%. In the dust core of Example 2, an average particle diameter of αFe nanocrystal which is crystallized therein is calculated to be 29 nm, and a crystallinity of αFe nanocrystal which is crystallized therein is calculated to be 46%. These teach that αFe nanocrystal, which has the average particle diameter of 40 nm or less while having the crystallinity of 35% or more, is formed in the soft magnetic powders of the dust cores of Example 1 and Example 2.

Examples 13 to 25 and Comparative Examples 9, 10

Industrial pure iron, ferrosilicon, ferrophosphorus, ferroboron and electrolytic copper were prepared as starting materials of soft magnetic powders of Examples 13 to 25 and Comparative Examples 9, 10 as listed below in Table 3. The starting materials were respectively weighed so as to provide alloy compositions of Examples 13 to 25 and Comparative Examples 9, 10 as listed in Table 3 and were melted by a high-frequency heating apparatus under argon atmosphere to form molten metals. Next, the formed molten metals were gas atomized and quenched in cooling water to manufacture soft magnetic powders each of whose average particle diameter is 50 μm. A rust condition of a surface of each of the manufactured soft magnetic powders was examined by visual inspection. An amount of an amorphous phase was estimated by identifying precipitate phases of each of the manufactured soft magnetic powders by X-ray diffraction analysis (XRD: X-ray diffraction). The manufactured soft magnetic powders were heat-treated by an electric furnace under argon atmosphere at heat treatment temperatures shown in Table 3. Saturation magnetic flux density Bs of each of the heat-treated soft magnetic powders was measured by using a vibrating-sample magnetometer (VMS). The measurement and examination results of the manufactured soft magnetic powders are shown in Table 3.

TABLE 3

| | | Atomized Powder | | | |
|---|---|---|---|---|---|
| | Alloy Composition | Amorphous Phase (%) | Rust | Heat Treatment Temperature (° C.) | Bs (T) |
| Comparative Example 9 | $Fe_{83.4}Si_4B_{5.5}P_{6.5}Cu_{0.6}$ | 89 | x | 420 | 1.72 |
| Example 13 | $Fe_{83.38}Si_4B_{5.5}P_{6.5}Cu_{0.6}Cr_{0.02}$ | 96 | Δ | 420 | 1.72 |
| Example 14 | $Fe_{83.3}Si_4B_{5.5}P_{6.5}Cu_{0.6}Cr_{0.1}$ | 99 | ○ | 420 | 1.73 |
| Example 15 | $Fe_{82.79}Si_4B_{5.5}P_{6.5}Cu_{0.69}Cr_{0.52}$ | 98 | ○ | 420 | 1.72 |
| Example 16 | $Fe_{82.1}Si_{2.9}B_5P_{8.8}Cu_{0.65}Cr_{0.55}$ | 100 | ◎ | 420 | 1.69 |
| Example 17 | $Fe_{82.5}Si_4B_{5.5}P_{6.5}Cu_{0.6}Cr_{0.9}$ | 100 | ◎ | 420 | 1.65 |
| Example 18 | $Fe_{82.15}Si_2B_{5.5}P_{8.5}Cu_{0.55}Cr_{1.3}$ | 100 | ◎ | 420 | 1.63 |
| Example 19 | $Fe_{81.65}Si_2B_{5.5}P_{8.5}Cu_{0.55}Cr_{1.8}$ | 100 | ◎ | 420 | 1.61 |
| Example 20 | $Fe_{82.2}Si_{2.5}B_6P_{8.2}Cu_{0.5}Cr_{0.6}$ | 100 | ○ | 420 | 1.62 |
| Example 21 | $Fe_{80.8}Si_4B_{5.5}P_{6.5}Cu_{0.6}Cr_{2.6}$ | 100 | ◎ | 440 | 1.58 |
| Example 22 | $Fe_{77.4}Si_4B_{5.5}P_{6.5}Cu_{0.6}Cr_6$ | 96 | ◎ | 460 | 1.34 |
| Example 23 | $Fe_{82.6}Si_4B_{5.5}P_{6.5}Cu_{0.88}Cr_{0.52}$ | 78 | ○ | 400 | 1.74 |
| Example 24 | $Fe_{82.93}Si_4B_{5.5}P_{6.5}Cu_{0.55}Cr_{0.52}$ | 100 | ○ | 420 | 1.71 |
| Example 25 | $Fe_{83.07}Si_4B_{5.5}P_{6.5}Cu_{0.41}Cr_{0.52}$ | 100 | Δ | 420 | 1.68 |
| Comparative Example 10 | $Fe_{83.19}Si_4B_{5.5}P_{6.5}Cu_{0.29}Cr_{0.52}$ | 100 | x | 440 | 1.62 |

As shown in Table. 3, rust is formed on a surface of Comparative Example 9 containing no Cr. On the other hand, substantially no rust is formed on surfaces of Examples 13 to 25. Examples 13 to 25 have saturation magnetic flux densities Bs of 1.34 to 1.74 T.

Dust cores were manufactured by using the soft magnetic powders of Examples 13 to 25 and Comparative Examples 9, 10. In detail, the soft magnetic powders manufactured as above were granulated by using silicone resin of 2 wt %, the granulated powders were molded at a molding pressure of 10 ton/cm$^2$, by using dies each having an outer diameter of 13 mm and an inner diameter of 8 mm, to manufacture molded bodies, and the molded bodies were cured. After that, the molded bodies were heat-treated by an electric furnace under argon atmosphere at heat treatment temperatures shown in Table 3, so that the dust cores were manufactured. Core loss of each of the manufactured dust cores was measured by using an alternating current BH analyzer under excitation conditions of 20 kHz and 100 mT. Additionally, a temperature and humidity controlled test, in which the manufactured dust cores were aged at 60° C. and 90% RH, was run, and a corrosion condition of each of the manufactured dust cores was visually inspected. The measurement and examination results of the manufactured dust cores are shown in Table 4.

TABLE 4

| | | Dust Core | |
|---|---|---|---|
| | Alloy Composition | Core Loss (kW/m$^3$) | Temperature and Humidity Controlled Test |
| Comparative Example 9 | $Fe_{83.4}Si_4B_{5.5}P_{6.5}Cu_{0.6}$ | 290 | X |
| Example 13 | $Fe_{83.38}Si_4B_{5.5}P_{6.5}Cu_{0.6}Cr_{0.02}$ | 180 | X |
| Example 14 | $Fe_{83.3}Si_4B_{5.5}P_{6.5}Cu_{0.6}Cr_{0.1}$ | 110 | Δ |
| Example 15 | $Fe_{82.79}Si_4B_{5.5}P_{6.5}Cu_{0.69}Cr_{0.52}$ | 100 | ○ |
| Example 16 | $Fe_{82.1}S_{i2.9}B_5P_{8.8}Cu_{0.65}Cr_{0.55}$ | 75 | ○ |
| Example 17 | $Fe_{82.5}Si_4B_{5.5}P_{6.5}Cu_{0.6}Cr_{0.9}$ | 80 | ◎ |
| Example 18 | $Fe_{82.15}Si_2B_{5.5}P_{8.5}Cu_{0.55}Cr_{1.3}$ | 80 | ◎ |
| Example 19 | $Fe_{81.65}Si_2B_{5.5}P_{8.5}Cu_{0.55}Cr_{1.8}$ | 90 | ◎ |
| Example 20 | $Fe_{82.2}Si_{2.5}B_6P_{8.2}Cu_{0.5}Cr_{0.6}$ | 90 | ○ |
| Example 21 | $Fe_{80.8}Si_4B_{5.5}P_{6.5}Cu_{0.6}Cr_{2.6}$ | 110 | ◎ |
| Example 22 | $Fe_{77.4}Si_4B_{5.5}P_{6.5}Cu_{0.6}Cr_6$ | 420 | ◎ |
| Example 23 | $Fe_{82.6}Si_4B_{5.5}P_{6.5}Cu_{0.88}Cr_{0.52}$ | 330 | ○ |

TABLE 4-continued

| | | Dust Core | |
|---|---|---|---|
| | Alloy Composition | Core Loss (kW/m$^3$) | Temperature and Humidity Controlled Test |
| Example 24 | $Fe_{82.93}Si_4B_{5.5}P_{6.5}Cu_{0.55}Cr_{0.52}$ | 110 | ○ |
| Example 25 | $Fe_{83.07}Si_4B_{5.5}P_{6.5}Cu_{0.41}Cr_{0.52}$ | 190 | Δ |
| Comparative Example 10 | $Fe_{83.19}Si_4B_{5.5}P_{6.5}Cu_{0.29}Cr_{0.52}$ | 660 | X |

As shown in Table 4, core losses of Comparative Examples 9, 10 are 290 to 660 kW/m$^3$. On the other hand, core losses of Examples 13 to 25 are 75 to 420 kW/m$^3$. The temperature and humidity controlled test causes Comparative Examples 9, 10 and Example 13 to have corrosion while causing substantially none of Examples 14 to 25 to have corrosion.

In the aforementioned measurement and examination results, comparison of Comparative Example 9 with Example 13 indicates that the soft magnetic powder with low Cr content has a dramatically increased amount of an amorphous phase while resisting rust. Comparison of Example 21 with Example 22 indicates that the Cr content of the soft magnetic powder is preferred to be equal to or less than 3 atomic %. Comparison of Example 18 with Example 19 indicates that the Cr content of the soft magnetic powder is more preferred to be equal to or less than 1.8 atomic % and is further preferred to be equal to or less than 1.5 atomic %. Comparison of Example 17 with Example 18 from the standpoint of saturation magnetic flux density Bs indicates that the Cr content of the soft magnetic powder is still preferred to be equal to or less than 1 atomic %. Comparison of Example 13 with Example 14 indicates that the Cr content of the soft magnetic powder is preferred to be equal to or greater than 0.1 atomic %. Comparison of Example 14 with Example 15 from the standpoint of core loss indicates that the Cr content of the soft magnetic powder is more preferred to be equal to or greater than 0.5 atomic %.

In the aforementioned measurement and examination results, comparisons of Comparative Example 10 with Examples 24, 25 indicate that rust resistivity of the soft magnetic powder is increased as the Cu content of the soft magnetic powder is increased. Comparison of Example 15 with Example 23 from the standpoint of amorphous phase and core loss indicates that the Cu content of the soft magnetic powder is preferred to be less than 0.7 atomic %. Comparison of Example 15 with Example 16 from the standpoint of amorphous phase and core loss indicates that the Cu content of the soft magnetic powder is more preferred to be equal to or less than 0.65 atomic %. Comparison of Comparative Example 10 with Example 25 indicates that the Cu content of the soft magnetic powder is preferred to be equal to or greater than 0.4 atomic %. Comparison of Example 24 with Example 25 indicates that the Cu content of the soft magnetic powder is more preferred to be equal to or greater than 0.5 atomic %.

Examples 26 to 36

Industrial pure iron, ferrosilicon, ferrophosphorus, ferroboron, electrolytic copper, ferrochrome, ferrocarbon, niobium, molybdenum, Co, Ni, tin, zinc and Mn were prepared as starting materials of soft magnetic powders of Examples 26 to 36 as listed below in Table 5. The starting materials were respectively weighed so as to provide alloy compositions of Examples 26 to 36 as listed in Table 5 and were melted by a high-frequency heating apparatus under argon atmosphere to form molten metals. Next, the formed molten metal is gas atomized and quenched in cooling water to manufacture soft magnetic powders each of whose average particle diameter is 50 μm. A rust condition of a surface of each of the manufactured soft magnetic powders was examined by visual inspection. An amount of an amorphous phase was estimated by identifying precipitate phases of each of the manufactured soft magnetic powders by X-ray diffraction analysis (XRD: X-ray diffraction). The manufactured soft magnetic powders were heat-treated by an electric furnace under argon atmosphere at heat treatment temperatures shown in Table 5. Saturation magnetic flux density Bs of each of the heat-treated soft magnetic powders was measured by using a vibrating-sample magnetometer (VMS). The measurement and examination results of the manufactured soft magnetic powders are shown in Table 5.

TABLE 5

| | Alloy Composition | Atomized Powder | | | |
|---|---|---|---|---|---|
| | | Amorphous Phase (%) | Rust | Heat treatment temperature (° C.) | Bs (T) |
| Example 26 | $Fe_{82.55}Si_2B_5P_{8.5}C_1Cu_{0.55}Cr_{0.4}$ | 100 | ○ | 400 | 1.65 |
| Example 27 | $Fe_{81.4}Si_3B_5P_{9.2}Cu_{0.6}Cr_{0.5}Nb_{0.3}$ | 100 | ◎ | 440 | 1.63 |
| Example 28 | $Fe_{81.65}Si_3B_{5.5}P_{8.1}Cu_{0.65}Cr_{0.6}Mo_{0.5}$ | 100 | ◎ | 440 | 1.61 |
| Example 29 | $Fe_{82.9}Si_{0.2}B_6P_9C_{0.3}Cu_{0.6}Cr_1$ | 100 | ◎ | 420 | 1.65 |
| Example 30 | $Fe_{80.9}Si_4B_5P_{9.2}Cu_{0.6}Cr_{0.3}$ | 98 | ○ | 440 | 1.58 |
| Example 31 | $Fe_{82.8}Si_1B_7P_{7.5}C_{0.5}Cu_{0.6}Cr_{0.6}$ | 100 | ◎ | 420 | 1.64 |
| Example 32 | $Fe_{80.3}Co_2Si_3B_5P_{8.5}Cu_{0.6}Cr_{0.6}$ | 100 | ○ | 420 | 1.72 |
| Example 33 | $Fe_{80.3}Ni_2Si_3B_5P_{8.5}Cu_{0.6}Cr_{0.6}$ | 100 | ○ | 420 | 1.63 |
| Example 34 | $Fe_{82.0}Zn_{0.3}Si_3B_5P_{8.5}Cu_{0.6}Cr_{0.6}$ | 100 | ○ | 420 | 1.63 |
| Example 35 | $Fe_{82.0}Sn_{0.3}Si_3B_5P_{8.5}Cu_{0.6}Cr_{0.6}$ | 100 | ○ | 420 | 1.63 |
| Example 36 | $Fe_{82.0}Mn_{0.3}Si_3B_5P_{8.5}Cu_{0.6}Cr_{0.6}$ | 100 | ○ | 420 | 1.62 |

In Examples 26 to 36, the M element (Co, Ni, Cu, Zn, Mn) is added and the Fe element is replaced with Nb, Mo, Sn, C or the like. As shown in Table 5, no rust is formed on surfaces of Examples 26 to 36, and Examples 26 to 36 have saturation magnetic flux densities Bs of 1.58 to 1.72 T. Comparisons of Example 26, Example 29 and Example 31 indicate that the soft magnetic powder, in which the Fe content is even high, can have a large amount of the amorphous phase if a part of the Fe element is replaced with C. Additionally, Example 32 indicates that the soft magnetic powder has improved saturation magnetic flux density Bs if the Co element is added thereto.

Dust cores were manufactured by using the soft magnetic powders of Examples 26 to 36. In detail, the soft magnetic powders manufactured as above were granulated by using silicone resin of 2 wt %, the granulated powders were molded at a molding pressure of 10 ton/cm$^2$, by using dies each having an outer diameter of 13 mm and an inner diameter of 8 mm, to manufacture molded bodies, and the molded bodies were cured. After that, the molded bodies were heat-treated by an electric furnace under argon atmosphere at heat treatment temperatures shown in Table 5, so that the dust cores were manufactured. Core loss of each of the manufactured dust cores was measured by using an alternating current BH analyzer under excitation conditions of 20 kHz and 100 mT. Additionally, a temperature and humidity controlled test, in which the manufactured dust cores were aged at 60° C. and 90% RH, was run, and a corrosion condition of each of the manufactured dust cores was visually inspected. The measurement and examination results of the manufactured dust cores are shown in Table 6.

TABLE 6

| | Alloy Composition | Dust Core: Core Loss ($kW/m^3$) | Dust Core: Temperature and Humidity Controlled Test |
|---|---|---|---|
| Example 26 | $Fe_{82.55}Si_2B_5P_{8.5}C_1Cu_{0.55}Cr_{0.4}$ | 80 | ○ |
| Example 27 | $Fe_{81.4}Si_3B_5P_{9.2}Cu_{0.6}Cr_{0.5}Nb_{0.3}$ | 75 | ◎ |
| Example 28 | $Fe_{81.85}Si_3B_{5.5}P_{8.1}Cu_{0.65}Cr_{0.6}Mo_{0.5}$ | 70 | ○ |
| Example 29 | $Fe_{82.9}Si_{0.2}B_6P_9C_{0.3}Cu_{0.6}Cr_1$ | 90 | ◎ |
| Example 30 | $Fe_{80.9}Si_4B_5P_{9.2}Cu_{0.6}Cr_{0.3}$ | 130 | ○ |
| Example 31 | $Fe_{82.8}Si_1B_7P_{7.5}C_{0.5}Cu_{0.6}Cr_{0.6}$ | 100 | ○ |
| Example 32 | $Fe_{80.3}Co_2Si_3B_5P_{8.5}Cu_{0.6}Cr_{0.6}$ | 110 | ○ |
| Example 33 | $Fe_{80.3}Ni_2Si_3B_5P_{8.5}Cu_{0.6}C_{r0.6}$ | 100 | ◎ |
| Example 34 | $Fe_{82.0}Zn_{0.3}Si_3B_5P_{8.5}Cu_{0.6}Cr_{0.6}$ | 90 | ◎ |
| Example 35 | $Fe_{82.0}Sn_{0.3}Si_3B_5P_{8.5}Cu_{0.6}Cr_{0.6}$ | 85 | ◎ |
| Example 36 | $Fe_{82.0}Mn_{0.2}Si_3B_5P_{8.5}Cu_{0.6}Cr_{0.6}$ | 95 | ○ |

As shown in Table 6, core losses of Examples 26 to 36 are 70 to 130 $kW/m^3$ which are low values. The temperature and humidity controlled test causes substantially none of Examples 26 to 36 to have corrosion.

The aforementioned measurement and examination results of Examples 26 to 29, 31 and 35 indicate that the soft magnetic powder has good soft magnetic properties and good resistance to corrosion if the Fe element is replaced with Nb, Mo, Sn or C at 3 atomic % or less. Especially, replacement with Nb or Mo similar to Examples 27 and 28 enables the soft magnetic powder to have reduced core loss and increased resistance to rust.

The aforementioned measurement and examination results of Examples 32 to 34 and 36 indicate that the soft magnetic powder has good soft magnetic properties and good resistance to corrosion if the M element other than Cu is added therein. Especially, it is understood that addition of Ni or Zn similar to Examples 33 and 34 enables the soft magnetic powder to have increased resistance to rust.

Examples 37 to 45, Comparative Example 11

Industrial pure iron, ferrosilicon, ferrophosphorus, ferroboron, electrolytic copper and ferrochrome were prepared as starting materials of soft magnetic powders of Examples 37 to 45 and Comparative Example 11 as listed below in Table 7. The starting materials were respectively weighed so as to provide alloy compositions of Examples 37 to 45 and Comparative Example 11 as listed in Table 7 and were melted by a high-frequency heating apparatus under argon atmosphere to form molten metals. Next, the formed molten metals were gas atomized and quenched in cooling water to manufacture soft magnetic powders each of whose average particle diameter is 50 μm. The manufactured soft magnetic powders were granulated by using silicone resin of 2 wt %, the granulated powders were molded at a molding pressure of 10 $ton/cm^2$, by using dies each having an outer diameter of 13 mm and an inner diameter of 8 mm, to manufacture molded bodies, and the molded bodies were cured. After that, the molded bodies were heat-treated by an electric furnace under argon atmosphere at heat treatment temperatures shown in Table 7, so that the dust cores were manufactured. Core loss of each of the manufactured dust cores was measured by using an alternating current BH analyzer under excitation conditions of 20 kHz and 100 mT. Furthermore, an average particle diameter and a crystallinity of αFe nanocrystal in the soft magnetic powder, which was contained in the dust core, and a crystallinity of a compound phase, other than a bcc phase, of αFe nanocrystal were calculated by proving a surface of the manufactured dust core by XRD, followed by analyzing the XRD result by WPPD method. The measurement and examination results of the manufactured dust cores are shown in Table 7. In Table 7, the average particle diameter of αFe nanocrystal, the crystallinity of αFe nanocrystal and the crystallinity of the compound phase, other than the bcc phase, of αFe nanocrystal are represented by αFe crystal diameter, αFe crystallinity, and compound crystallinity, respectively.

TABLE 7

| | Alloy Composition | Dust Core: Heat Treatment Condition | Dust Core: Core Loss ($kW/m^3$) | Dust Core: αFe Crystal Diameter (nm) | Dust Core: αFe Crystallinity (%) | Dust Core: Compound Crystallinity (%) |
|---|---|---|---|---|---|---|
| Example 37 | $Fe_{82.1}Si_{3.5}B_5P_{8.2}Cu_{0.65}Cr_{0.55}$ | 380° C. × 120 minutes | 200 | 38 | 38 | 0 |
| Example 38 | $Fe_{82.1}Si_{3.5}B_5P_{8.2}Cu_{0.65}Cr_{0.55}$ | 420° C. × 20 minutes | 75 | 29 | 45 | 0 |
| Example 39 | $Fe_{82.1}Si_{3.5}B_5P_{8.2}Cu_{0.65}Cr_{0.55}$ | 440° C. × 20 minutes | 75 | 25 | 48 | 0 |
| Example 40 | $Fe_{82.1}Si_{3.5}B_5P_{8.2}Cu_{0.65}Cr_{0.55}$ | 440° C. × 60 minutes | 90 | 33 | 49 | 3 |
| Example 41 | $Fe_{82.1}Si_{3.5}B_5P_{8.2}Cu_{0.65}Cr_{0.55}$ | 440° C. × 120 minutes | 190 | 32 | 49 | 7 |
| Example 42 | $Fe_{82.1}Si_{3.5}B_5P_{8.2}Cu_{0.65}Cr_{0.55}$ | 460° C. × 120 minutes | 640 | 31 | 51 | 16 |

TABLE 7-continued

| | Alloy Composition | Dust Core | | | | |
|---|---|---|---|---|---|---|
| | | Heat Treatment Condition | Core Loss (kW/m³) | αFe Crystal Diameter (nm) | αFe Crystallinity (%) | Compound Crystallinity (%) |
| Comparative Example 11 | $Fe_{83.7}Si_{1.8}B_{9.2}P_{4.1}Cu_{0.68}Cr_{0.52}$ | 380° C. × 120 minutes | 550 | 57 | 44 | 0 |
| Example 43 | $Fe_{82.5}Si_4B_{5.5}P_{6.5}Cu_{0.6}Cr_{0.9}$ | 350° C. × 240 minutes | 330 | 47 | 33 | 0 |
| Example 44 | $Fe_{82.5}Si_4B_{5.5}P_{6.5}Cu_{0.6}Cr_{0.9}$ | 420° C. × 20 minutes | 80 | 34 | 44 | 0 |
| Example 45 | $Fe_{82.5}Si_4B_{5.5}P_{6.5}Cu_{0.6}Cr_{0.9}$ | 440° C. × 120 minutes | 180 | 37 | 46 | 5 |

Examples 37 to 42 have the same element composition, and only their heat treatment conditions are different from each other. Similarly, Examples 43 to 45 have the same element composition, and only their heat treatment conditions are different from each other. As shown in Table 7, it is understood that the dust cores having the same element composition are different in core loss, average particle diameter of αFe nanocrystal, crystallinity of αFe nanocrystal and crystallinity of the compound phase, other than the bcc phase, of αFe nanocrystal from each other due to their differences of the heat treatment conditions.

As shown in Table 7, it is understood that heat treatment thereto at an appropriate temperature and for an appropriate period of time enables decrease of the particle diameter of αFe nanocrystal, increase of the crystallinity of αFe nanocrystal, decrease of the crystallinity of the compound phase, other than the bcc phase, of αFe nanocrystal and reduction of the core loss of the dust core.

Comparison of Comparative Example 11 with Example 43 from a standpoint of core loss and particle diameter of αFe nanocrystal indicates that the core loss is increased when the particle diameter of αFe nanocrystal is large similar to Comparative Example 11. Therefore, it is understood that the particle diameter of αFe nanocrystal is preferred to be equal to or less than 50 nm.

Comparison of Example 37 with Example 47 from a standpoint of core loss and crystallinity of αFe nanocrystal indicates that, when the crystallinity of αFe nanocrystal is low similar to Example 43, the magnetostriction is not sufficiently decreased while the core loss is increased. Therefore, it is understood that the crystallinity of αFe nanocrystal is preferred to be equal to or greater than 35%.

Referring to Examples 40, 41, 42 and 45, it is understood that the core loss is increased as the crystallinity of the compound phase, other than the bcc phase, of αFe nanocrystal is increased. Therefore, referring to Examples 40, 41 and 45, it is understood that the crystallinity of the compound phase, other than the bcc phase, of αFe nanocrystal is preferred to be equal to or less than 7%, and the crystallinity of the compound phase is more preferred to be equal to or less than 5%, and the crystallinity of the compound phase is further preferred to be equal to or less than 3%.

Examples 46 to 66

Industrial pure iron, ferrosilicon, ferrophosphorus, ferroboron, electrolytic copper, ferrochrome, Mn, Al, Ti and FeS were prepared as starting materials of soft magnetic powders of Examples 46 to 66 as listed below in Table 8. The starting materials were respectively weighed so as to provide alloy compositions of Examples 46 to 66 as listed in Table 8 and were melted by a high-frequency heating apparatus under argon atmosphere to form molten metals. Next, the formed molten metals were gas atomized and quenched in cooling water to manufacture soft magnetic powders each of whose average particle diameter is 50 μm.

TABLE 8

| | Alloy Composition | Microelements | | | | |
|---|---|---|---|---|---|---|
| | | Al (wt %) | Ti (wt %) | S (wt %) | N (wt %) | O (wt %) |
| Example46 | $Fe_{81.59}Si_3B_6P_{8.3}Cu_{0.6}Cr_{0.51}$ | 0.003 | 0.002 | 0.02 | 0.0005 | 0.12 |
| Example 47 | $Fe_{81.59}Si_3B_6P_{8.3}Cu_{0.6}Cr_{0.51}$ | 0.24 | 0.003 | 0.018 | 0.0022 | 0.26 |
| Example 48 | $Fe_{81.59}Si_3B_6P_{8.3}Cu_{0.6}Cr_{0.51}$ | 0.04 | 0.002 | 0.02 | 0.0007 | 0.29 |
| Example 49 | $Fe_{81.59}Si_3B_6P_{8.3}Cu_{0.6}Cr_{0.51}$ | 0.009 | 0.003 | 0.023 | 0.001 | 0.14 |
| Example 50 | $Fe_{81.59}Si_3B_6P_{8.3}Cu_{0.6}Cr_{0.51}$ | 0.002 | 0.31 | 0.021 | 0.0018 | 0.56 |
| Example 51 | $Fe_{81.59}Si_3B_6P_{8.3}Cu_{0.6}Cr_{0.51}$ | 0.003 | 0.03 | 0.023 | 0.0008 | 0.22 |
| Example 52 | $Fe_{81.59}Si_3B_6P_{8.3}Cu_{0.6}Cr_{0.51}$ | 0.001 | 0.007 | 0.018 | 0.0009 | 0.16 |
| Example 53 | $Fe_{81.59}Si_3B_6P_{8.3}Cu_{0.6}Cr_{0.51}$ | 0.002 | 0.002 | 1.1 | 0.001 | 0.08 |
| Example 54 | $Fe_{81.59}Si_3B_6P_{8.3}Cu_{0.6}Cr_{0.51}$ | 0.001 | 0.001 | 0.24 | 0.0008 | 0.11 |
| Example 55 | $Fe_{81.59}Si_3B_6P_{8.3}Cu_{0.6}Cr_{0.51}$ | 0.002 | 0.002 | 0.08 | 0.0009 | 0.09 |
| Example 56 | $Fe_{81.59}Si_3B_6P_{8.3}Cu_{0.6}Cr_{0.51}$ | 0.002 | 0.002 | 0.024 | 0.015 | 0.25 |
| Example 57 | $Fe_{81.59}Si_3B_6P_{8.3}Cu_{0.6}Cr_{0.51}$ | 0.002 | 0.001 | 0.022 | 0.005 | 0.14 |
| Example 58 | $Fe_{81.59}Si_3B_6P_{8.3}Cu_{0.6}Cr_{0.51}$ | 0.001 | 0.002 | 0.021 | 0.0018 | 0.12 |
| Example 59 | $Fe_{81.59}Si_3B_6P_{8.3}Cu_{0.6}Cr_{0.51}$ | 0.002 | 0.003 | 0.02 | 0.0008 | 0.9 |
| Example 60 | $Fe_{81.59}Si_3B_6P_{8.3}Cu_{0.6}Cr_{0.51}$ | 0.002 | 0.002 | 0.024 | 0.0009 | 0.42 |
| Example 61 | $Fe_{81.59}Si_3B_6P_{8.3}Cu_{0.6}Cr_{0.51}$ | 0.01 | 0.03 | 0.022 | 0.0012 | 0.29 |
| Example 62 | $Fe_{81.59}Si_3B_6P_{8.3}Cu_{0.6}Cr_{0.51}$ | 0.0003 | 0.0002 | 0.0004 | 0.0003 | 0.025 |
| Example 63 | $Fe_{82.1}Si_{2.9}B_5P_{8.8}Cu_{0.65}Cr_{0.55}$ | 0.002 | 0.001 | 0.018 | 0.0011 | 0.08 |
| Example 64 | $Fe_{80.9}Si_4B_5P_{9.2}Cu_{0.6}Cr_{0.3}$ | 0.003 | 0.003 | 0.021 | 0.0013 | 0.14 |

TABLE 8-continued

| | Alloy Composition | Microelements | | | | |
|---|---|---|---|---|---|---|
| | | Al (wt %) | Ti (wt %) | S (wt %) | N (wt %) | O (wt %) |
| Example 65 | $Fe_{82.8}Si_1B_7P_{7.5}C_{0.5}Cu_{0.6}Cr_{0.6}$ | 0.001 | 0.002 | 0.014 | 0.0008 | 0.12 |
| Example 66 | $Fe_{80.8}Si_4B_{5.5}P_{6.5}Cu_{0.6}Cr_{2.6}$ | 0.008 | 0.003 | 0.015 | 0.0011 | 0.21 |

A rust condition of a surface of each of the soft magnetic powders of Examples 46 to 66 was examined by visual inspection. An amount of an amorphous phase was estimated by identifying precipitate phases of each of the manufactured soft magnetic powders by X-ray diffraction analysis (XRD: X-ray diffraction). The manufactured soft magnetic powders were heat-treated by an electric furnace under argon atmosphere at heat treatment temperatures shown in Table 9, and saturation magnetic flux density Bs of each of the heat-treated soft magnetic powders was measured by using a vibrating-sample magnetometer (VMS). The measurement and examination results of the manufactured soft magnetic powders are shown in Table 9.

Dust cores were manufactured by using the soft magnetic powders of Examples 44 to 66. In detail, the soft magnetic powders manufactured as above were granulated by using silicone resin of 2 wt %, the granulated powders were molded at a molding pressure of 10 ton/cm$^2$, by using dies each having an outer diameter of 13 mm and an inner diameter of 8 mm, to manufacture molded bodies, and the molded bodies were cured. After that, the molded bodies were heat-treated by an electric furnace under argon atmosphere at heat treatment temperatures shown in Table 9, so that the dust cores were manufactured. Core loss of each of the manufactured dust cores was measured by using an alternating current BH analyzer under excitation conditions of 20 kHz and 100 mT. Additionally, a temperature and humidity controlled test, in which the manufactured dust cores were aged at 60° C. and 90% RH, was run, and a corrosion condition of each of the manufactured dust cores was visually inspected. The measurement and examination results of the manufactured dust cores are shown in Table 9.

TABLE 9

| | Atomized Powder | | | | Dust Core | |
|---|---|---|---|---|---|---|
| | Amorphous Phase (%) | Rust | Heat Treatment Temperature (° C.) | Bs (T) | Core Loss (kW/m$^3$) | Temperature and Humidity Controlled Test |
| Example46 | 99 | ○ | 420 | 1.61 | 75 | ○ |
| Example 47 | 54 | ○ | 420 | 1.59 | 780 | ○ |
| Example 48 | 98 | ○ | 420 | 1.61 | 150 | ○ |
| Example 49 | 99 | ○ | 420 | 1.61 | 90 | ○ |
| Example 50 | 41 | Δ | 420 | 1.59 | 1180 | Δ |
| Example 51 | 96 | ○ | 420 | 1.61 | 170 | ○ |
| Example 52 | 98 | ○ | 420 | 1.62 | 120 | ○ |
| Example 53 | 92 | ○ | 420 | 1.54 | 220 | Δ |
| Example 54 | 98 | ○ | 420 | 1.6 | 70 | Δ |
| Example 55 | 99 | ○ | 420 | 1.61 | 75 | Δ |
| Example 56 | 94 | ○ | 420 | 1.64 | 200 | ○ |
| Example 57 | 98 | ○ | 420 | 1.62 | 120 | ○ |
| Example 58 | 99 | ○ | 420 | 1.61 | 80 | ○ |
| Example 59 | 98 | Δ | 420 | 1.58 | 320 | X |
| Example 60 | 99 | ○ | 420 | 1.58 | 140 | Δ |
| Example 61 | 96 | ○ | 420 | 1.6 | 180 | ○ |
| Example 62 | 100 | ○ | 420 | 1.64 | 70 | ○ |
| Example 63 | 100 | ○ | 420 | 1.67 | 85 | ○ |

TABLE 9-continued

| | Atomized Powder | | | | Dust Core | |
|---|---|---|---|---|---|---|
| | Amorphous Phase (%) | Rust | Heat Treatment Temperature (° C.) | Bs (T) | Core Loss (kW/m$^3$) | Temperature and Humidity Controlled Test |
| Example 64 | 97 | ○ | 440 | 1.59 | 160 | ○ |
| Example 65 | 100 | ◎ | 420 | 1.64 | 110 | ○ |
| Example 66 | 99 | ◎ | 440 | 1.58 | 140 | ◎ |

Examples 46 to 66 contain various contents of Al, Ti, S, N and O as microelements. In addition, Examples 46 to 62 have the same element composition of Fe, Si, B, P, Cu and Cr. Table 9 indicates that Examples 46, 48, 49 and 51 to 66 have amorphous phases of 92% or more which are high values. Table 9 also indicates that Examples 46 to 52 and 54 to 66 have saturation magnetic flux densities Bs of 1.58 T or more which are satisfactory values. In addition, table 9 indicates that Examples 46, 48, 49, 51 to 58 and 60 to 66 have core losses of 220 kW/m$^3$ or less which are satisfactory values. On the other hand, Examples 47, Example 50, Example 53 and Example 59, each of which has increased contents of Al, Ti, S and O of the microelements, have decreased saturation magnetic flux densities Bs which are lower than those of remaining examples, each having reduced contents of the microelements, of Table 9. However, it is understood that the saturation magnetic flux densities Bs of Example 47, Example 50, Example 53 and Example 59 are values each of which is equal to or greater than 1.54 T.

Referring to Example 46 and Examples 47 to 49, it is understood that, as the Al content is increased, the amount of the amorphous phase and the saturation magnetic flux density Bs are decreased while the core loss is increased. Specifically, it is understood that the Al content is preferred to be equal to or less than 0.05 wt % from a standpoint of saturation magnetic flux density Bs and core loss and that the Al content is more preferred to be equal to or less than 0.005 wt % from a standpoint of reduction of core loss.

Referring to Examples 46 and Examples 50 to 52, it is understood that, as the Ti content is increased, the amount of the amorphous phase and the saturation magnetic flux density Bs are decreased while the core loss is increased. Specifically, it is understood that the Ti content is preferred to be equal to or less than 0.05 wt % from the standpoint of saturation magnetic flux density Bs and core loss and that the Ti content is more preferred to be equal to or less than 0.005 wt % from the standpoint of reduction of core loss.

Referring to Example 46 and Examples 53 to 55, it is understood that, as the S content is increased, the amount of the amorphous phase and the saturation magnetic flux density Bs are decreased. It is understood that the S content is preferred to be equal to or less than 0.5 wt % from the standpoint of saturation magnetic flux density Bs and amount of the amorphous phase and that the S content is more preferred to be equal to or less than 0.05 wt % from a standpoint of corrosion resistance.

Referring to Example 46 and Examples 56 to 58, it is understood that, as the N content is increased, the amount of the amorphous phase is decreased while the core loss is increased. Specifically, it is understood that, from a standpoint of amount of the amorphous phase and core loss, the N content is preferred to be equal to or less than 0.01 wt % and is more preferred to be equal to or less than 0.002 wt %.

Referring to Example 59, Example 60 and Example 61, it is understood that the corrosion resistance is decreased as the O content is increased. Specifically, it is understood that, from the standpoint of corrosion resistance, the O content is preferred to be equal to or less than 1 wt % and is more preferred to be equal to or less than 0.3 wt %.

(Inductor)

An inductor was manufactured by using a soft magnetic powder of the present embodiment, and DC bias characteristics of the manufactured inductor were measured. A method of manufacturing the inductor is described below.

First, Industrial pure iron, ferrosilicon, ferrophosphorus, ferroboron and electrolytic copper were prepared as starting materials of the soft magnetic powder. The starting materials were respectively weighed so as to provide alloy compositions of $Fe_{82.1}Si_{2.9}B_5P_{8.8}Cu_{0.65}Cr_{0.55}$ and were melted by a high-frequency heating apparatus under argon atmosphere to form a molten metal. Next, the formed molten metal was gas atomized and quenched in cooling water to manufacture a soft magnetic powder A whose average particle diameter is 50 μm. Additionally, the formed molten metal was water atomized to manufacture a soft magnetic powder B whose average particle diameter is 10 μm. The manufactured soft magnetic powders A and B were mixed to form a mixture having a mass ratio of A:B=8:2, silicone resin as a binder was added to the mixture to form another mixture and the another mixture was further mixed, and the another mixture consisting of the soft magnetic powders A and B and the binder was granulated to form a granulated powder. In this case, the silicone resin as the binder was added to the mixture of the soft magnetic powder A and the soft magnetic powder B so that a mixing ratio of the silicone resin to a total amount of the soft magnetic powder A and the soft magnetic powder B was 2 wt %.

Then, a coil 120 shown in FIG. 1 was prepared as a coil. This coil 120 is formed by winding a flat wire 121 edgewise, and a number of its turns is 3.5. The flat wire 121 has a rectangular cross-sectional shape of 2.0 mm×0.6 mm, and has an insulating layer, which is made of polyamide-imide, of 20 μm thickness on its surface. In addition, the coil 120 has surface mount terminals 122 at opposite ends, respectively. Under a state where the coil 120 is positioned in a metal mold, the granulated powder is poured into a cavity of the metal mold, and the granulated powder and the coil 120 are then press-molded together at a molding pressure of 5 ton/cm$^2$ to be cured to manufacture a molded body. The molded body was heat-treated by an electric furnace under argon atmosphere at 400° C. for 30 minutes, so that an inductor 100 of Example, in which the coil 120 is embedded in a dust core 110, was manufactured.

In addition, an inductor 100A of Comparative Example, in which a coil 120 is embedded in a dust core 110A, was manufactured, by using Fe—Si—Cr powder instead of the soft magnetic powders A and B, through a manufacturing method similar to that of the inductor 100 of Example as described above. Since the coil 120 of the inductor 100A of Comparative Example has a structure similar to that of the coil 120 of the inductor 100 of Example, detail explanation thereabout will be omitted.

Figure 2:
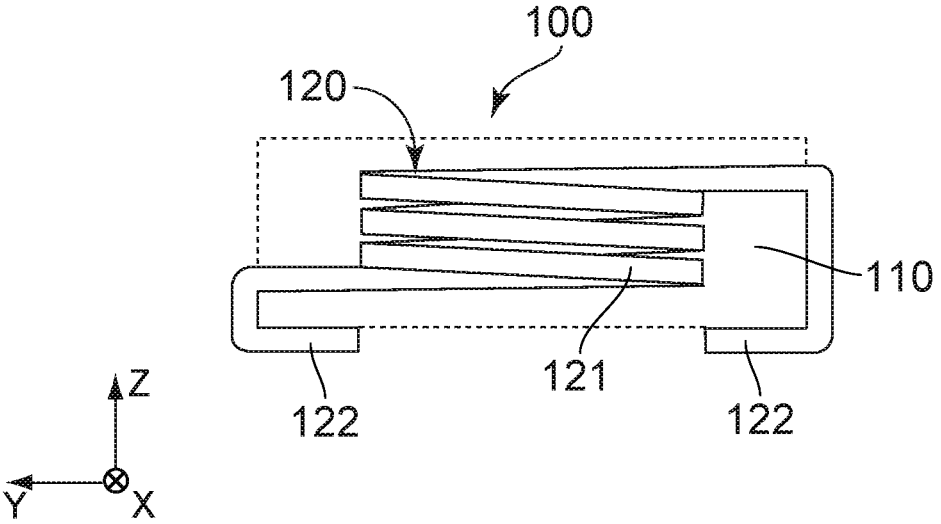
FIG. 2 is a side view showing the inductor of FIG. 1. In the figure, the outline of the dust core is illustrated by dotted line.

As shown in FIGS. 1 and 2, the inductor 100 of Example is an integrally molded inductor 100 in which the coil 120 is embedded in the dust core 110. Each of the surface mount terminals 122 of the coil 120 extends to the outside of the dust core 110.

Figure 3:
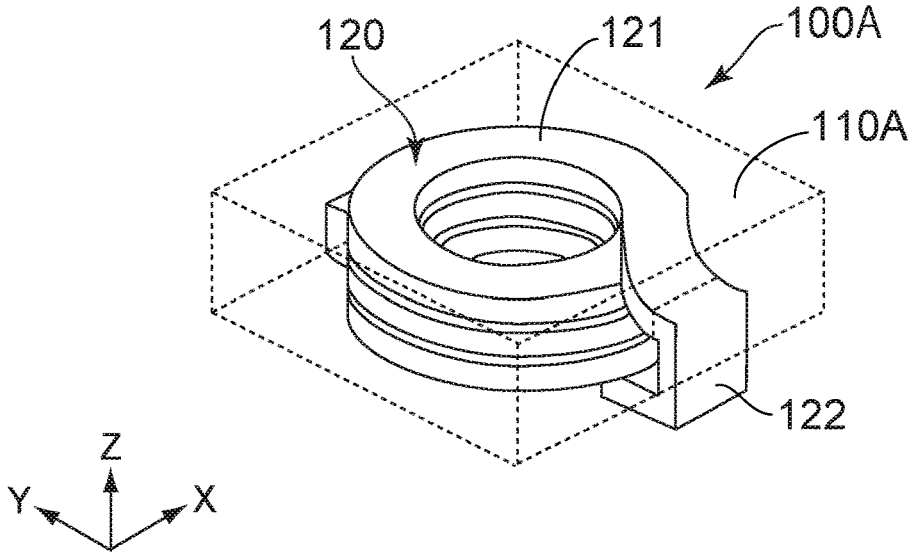
FIG. 3 is a perspective view showing an inductor of Comparative Example. In the figure, an outline of a dust core is illustrated by dotted line.

As shown in FIG. 3, similar to the inductor 100, the inductor 100A of Comparative Example is an integrally molded inductor 100A in which the coil 120 is embedded in the dust core 110A, and each of surface mount terminals 122 of the coil 120 extends to the outside of the dust core 110A.

Figure 4:
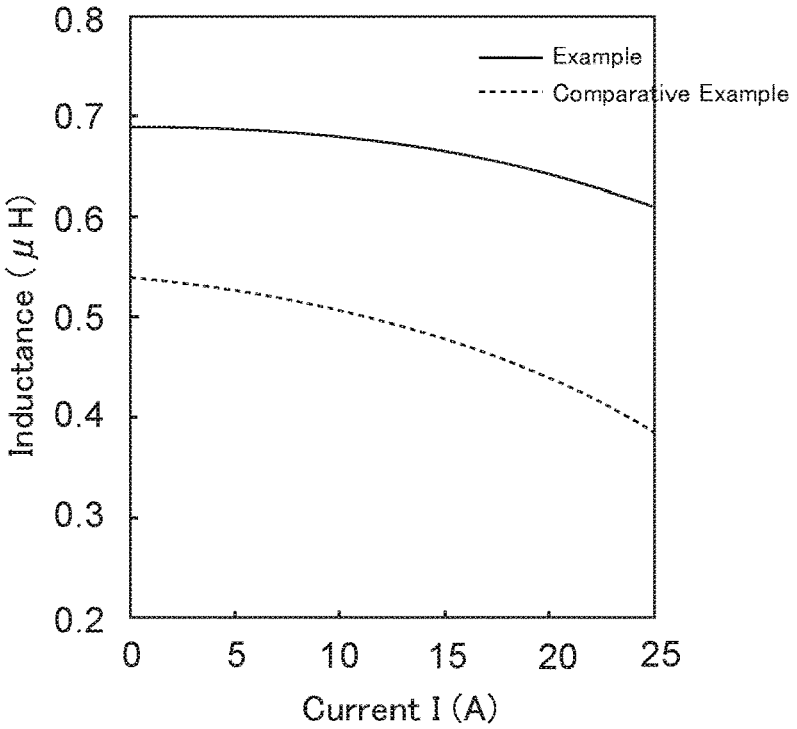
FIG. 4 is a graph showing DC bias characteristics of the inductors of FIGS. 1 and 3. In the graph, Example is represented by solid line while Comparative Example is represented by broken line.

FIG. 4 shows DC bias characteristics of the inductor 100 of Example and the inductor 100A of Comparative Example. FIG. 4 indicates that the inductor 100 of Example has a reduced ratio of a diminution of inductance L to an increment of applied current I as compared with that of the inductor 100A of Comparative Example. In other words, it is understood that the inductor 100 of Example has excellent DC bias characteristics as compared with the inductor 100A of Comparative Example.

The present application is based on a Japanese patent applications of JP2017-27162 filed before the Japan Patent Office on Feb. 16, 2017 and JP2017-206608 filed before the Japan Patent Office on Oct. 25, 2017, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

REFERENCE SIGNS LIST

100, 100A inductor
110, 110A dust core
120 coil
121 flat wire
122 surface mount terminal

The invention claimed is:

1. A soft magnetic powder represented by $Fe_aSi_bB_cP_dCr_eM_f$, except for inevitable impurities and containing O in an amount of at least 0.025 wt % and at most 1.0 wt %, wherein:

78 atomic %≤a≤85 atomic %;
0.1 atomic %≤b≤6 atomic %;
4 atomic %≤c≤10 atomic %;
5 atomic %≤d≤12 atomic %;
0 atomic %<e≤3 atomic %;
0.4 atomic %≤f<6 atomic %;
a+b+c+d+e+f=100 atomic %;
$M_f$ is represented by $Cu_gM'_h$, where M' is at least one element selected from Co, Ni and Zn;
0.4 atomic %≤g<0.7 atomic %;
f=g+h;
the soft magnetic powder contains a plurality of nanocrystals;
the nanocrystal has a bcc phase and a compound phase; and
the compound phase has a crystallinity of greater than 0 and at most 5%.

2. The soft magnetic powder as recited in claim 1, wherein 0.5 atomic %≤g≤0.65 atomic %.

3. The soft magnetic powder as recited in claim 1, wherein:

(0.2e−0.1) atomic %≤g≤(2e+0.5) atomic %; and (6−2e) atomic %≤d≤(21−5e) atomic %.

4. The soft magnetic powder as recited in claim 1, wherein:

5 atomic %<d≤10 atomic %; and 0.1 atomic %≤e≤3 atomic %.

5. The soft magnetic powder as recited in claim 1, wherein:

6 atomic %<d≤8 atomic %; and 0.5 atomic %≤e≤3 atomic %.

6. The soft magnetic powder as recited in claim 1, wherein 8 atomic %<d 10 atomic %.

7. The soft magnetic powder as recited in claim 1, wherein Fe is replaced with at least one element selected from Nb, Zr, Hf, Mo, Ta, W, Ag, Au, Pd, K, Ca, Mg, Sn, Ti, Al, S, C, O, N, Y and rare-earth elements at at most 3 atomic %.

8. The soft magnetic powder as recited in claim 1, wherein:

79 atomic %≤a≤83.5 atomic %; and 0 atomic %<e≤1.8 atomic %.

9. The soft magnetic powder as recited in claim 1, wherein 80.5 atomic %≤a≤85 atomic %.

10. The soft magnetic powder as recited in claim 1, wherein 0 atomic %<e≤1.5 atomic %.

11. The soft magnetic powder as recited in claim 1, wherein 0 atomic %<e≤1.0 atomic %.

12. The soft magnetic powder as recited in claim 1, wherein the soft magnetic powder contains Al of at most 0.05 wt %, Ti of at most 0.05 wt %, S of at most 0.5 wt %, and N of at most 0.01 wt %.

13. The soft magnetic powder as recited in claim 1, wherein the soft magnetic powder contains Al of at most 0.005 wt %, Ti of at most 0.005 wt %, S of at most 0.05 wt %, N of at most 0.002 wt %, and O in an amount of at least 0.025 wt % and at most 0.3 wt %.

14. The soft magnetic powder as recited in claim 1, wherein the soft magnetic powder has an average particle diameter of at most 200 μm.

15. The soft magnetic powder as recited in claim 1, wherein the soft magnetic powder contains an amorphous phase of at least 90%.

16. The soft magnetic powder as recited in claim 1, wherein the soft magnetic powder has a tap density of at least 3.5 g/cm$^3$.

17. The soft magnetic powder as recited in claim 1, wherein:

the nanocrystal has a crystallinity of at least 35%.

18. A dust core using the soft magnetic powder as recited in claim 1.

19. A method of manufacturing a dust core, the method comprising:

forming a mixture of the soft magnetic powder as recited in claim 1 and a binder;

manufacturing a molded body by press-molding the mixture; and heat-treating the molded body.

20. A method of manufacturing a magnetic core of an inductor, the method comprising:

forming a mixture of the soft magnetic powder as recited in claim 1 and a binder;

manufacturing a molded body by press-molding the mixture and a coil together; and heat-treating the molded body.

21. A magnetic component using the soft magnetic powder as recited in claim 1.

* * * * *